US009975695B2

(12) United States Patent
Reeb et al.

(10) Patent No.: US 9,975,695 B2
(45) Date of Patent: May 22, 2018

(54) LOCKING DEVICE FOR FRONT LOAD CONTAINER

(71) Applicant: SERIO-US INDUSTRIES, INC., Baltimore, MD (US)

(72) Inventors: David L. Reeb, Sykesville, MD (US); James L. Martin, II, Gambrills, MD (US)

(73) Assignee: Serio-Us Industries, Inc., Baltimore, MD (US)

( * ) Notice: Subject to any disclaimer, the term of this patent is extended or adjusted under 35 U.S.C. 154(b) by 374 days.

(21) Appl. No.: 14/730,015

(22) Filed: Jun. 3, 2015

(65) Prior Publication Data

US 2016/0355334 A1 Dec. 8, 2016

(51) Int. Cl.

| | |
|---|---|
| ***E05C 19/00*** | (2006.01) |
| ***B65F 1/16*** | (2006.01) |
| ***E05B 15/00*** | (2006.01) |
| ***E05B 63/00*** | (2006.01) |
| ***E05B 65/00*** | (2006.01) |
| ***E05B 65/52*** | (2006.01) |
| *E05C 19/18* | (2006.01) |

(52) U.S. Cl.

CPC ..... *B65F 1/1615* (2013.01); *E05B 15/0093* (2013.01); *E05B 63/0052* (2013.01); *E05B 65/006* (2013.01); *E05B 65/52* (2013.01); *E05C 19/003* (2013.01); *E05C 19/005* (2013.01)

(58) Field of Classification Search

CPC .. E05C 19/003; E05C 19/005; E05B 15/0093; E05B 65/006; B65F 1/1615

USPC ..... 292/148, 230, 231, 238, 259 R; 220/315, 220/908

See application file for complete search history.

(56) References Cited

U.S. PATENT DOCUMENTS 1,122,902 A * 12/1914 Gassier ..... B65F 3/12 414/407
4,349,223 A * 9/1982 Spector ..... E05C 19/003 292/259 R (Continued)

FOREIGN PATENT DOCUMENTS

FR 2533961 A1 * 4/1984 ..... E05C 19/003
FR 2605601 A2 * 4/1988 ..... B65D 55/12
GB 2272361 A * 5/1994 ..... B65F 1/06

OTHER PUBLICATIONS

Corresponding ISR for PCT/US2016/035667.

*Primary Examiner* — Carlos Lugo
(74) *Attorney, Agent, or Firm* — Berenato & White, LLC

(57) ABSTRACT

A locking device for a container having a hinged lid, comprises a base unit adapted to be fixed to the container and a pivotable unit mounted to the base unit and pivotally movable between on open and closed positions. The base unit includes a base member and a pinion member non-movably attached to the base member. The pivotable unit includes a locking mechanism comprising a pivotable locking member, a sliding member reciprocating between the locking member and the pinion member. The locking member is movable between a blocking position preventing the movement of the sliding member relative the pinion member so as to prevent relative movement between the pivoting unit and the base unit, and a release position permitting the movement of the sliding member relative the pinion member so as to permit relative movement between the pivoting unit and the base unit.

20 Claims, 22 Drawing Sheets

(56) References Cited

U.S. PATENT DOCUMENTS 4,844,113 A 7/1989 Jones
5,094,358 A 3/1992 Serio, Sr.
5,149,153 A 9/1992 Drewry et al.
5,152,562 A 10/1992 Stevenson et al.
5,201,434 A 4/1993 De Vivo et al.
5,203,664 A * 4/1993 Jensen ..... B65F 1/16 220/812
5,213,382 A 5/1993 Dawdy et al.
5,224,743 A 7/1993 Dawdy et al.
5,224,744 A 7/1993 Michelutti
5,388,876 A 2/1995 Saincome
5,415,314 A 5/1995 McCollum
5,419,598 A 5/1995 Kreitzer
5,474,341 A 12/1995 Putman et al.
5,490,606 A 2/1996 Lombardo
5,599,050 A 2/1997 Tinsley
5,662,364 A 9/1997 Reeb et al.
5,683,126 A 11/1997 De Vivo et al.
5,697,655 A 12/1997 Strong
5,836,625 A * 11/1998 Kibble ..... E05B 15/0053 292/145
5,997,052 A 12/1999 Reeb et al.
6,290,093 B1 9/2001 Obriot et al.
6,382,688 B1 5/2002 Agostini
6,390,321 B1 * 5/2002 Wang ..... B65F 1/1607 220/263
6,550,827 B1 4/2003 Tsujino
6,666,485 B1 12/2003 Moret
6,733,053 B2 5/2004 Hodge et al.
6,802,550 B1 10/2004 Griggs, Jr. et al.
6,808,080 B2 10/2004 Spiers et al.
6,851,288 B2 2/2005 Howes
7,234,327 B2 6/2007 Howes
7,506,902 B2 3/2009 Sheng et al.
7,806,447 B2 10/2010 Reeb
2007/0181579 A1 * 8/2007 Kuo ..... B65F 1/163 220/264
2009/0066092 A1 3/2009 Reeb
2009/0091141 A1 4/2009 Kreitzer
2010/0102061 A1 * 4/2010 Hamaguchi ..... B60N 3/08 220/255
2010/0102575 A1 4/2010 Ferkovich et al.
2011/0113695 A1 * 5/2011 Derham ..... E05B 43/00 49/445
2014/0299602 A1 * 10/2014 Manssourian ..... B65F 1/1615 220/315

* cited by examiner

LOCKING DEVICE FOR FRONT LOAD CONTAINER

BACKGROUND OF THE INVENTION

1. Field of the Invention

The present invention generally relates to waste containers and, more particularly, relates to a safety locking device for waste containers.

2. Description of the Related Art

As is well known, waste containers, such as refuse dumpsters for use in residential and industrial applications, typically include a container supported on a base structure. With the advent of mechanized trash removal, there have been created a number of large sized trash bins or dumpster containers. These containers usually comprise a block-shaped or pyramid-shaped container with a hinged lid attached to one side thereof. The container further includes attachments for accommodating various forked lifting mechanisms of the trash removal vehicle. The containers are lifted by the lifting mechanism of the trash removal vehicle and pivoted in some fashion so that the hinged top of the container opens and the trash contained therein is emptied into the vehicle. The container is then returned to a position on the ground, and the hinged lid closes on top of the container. Many of these large trash receptacles are rented from a trash removal service. These receptacles are not provided free of charge, and consequently their frequent emptying and service can become a considerable expense. This expense is increased when unauthorized users of the receptacle freely deposit trash therein. This unauthorized use necessitates a more frequent emptying of the container, and of course the unauthorized user does not contribute to the increased expense.

In order to reduce the added expense that comes from unauthorized use, the dumpsters must be locked. While conventional chains and padlocks reduce unauthorized dumpster use, they also add to operating expenses because the driver of the truck emptying the dumpster must get out of the truck to unlock the padlock on the dumpster. In the early 1990's, companies began the development and marketing of dumpster locking mechanisms that open automatically when the dumpster is lifted and inverted to dump the trash into the truck. With such as automatic lock, the driver is not required to leave the truck which saves the trash company hundreds of dollars each year.

Conventional automatic locks are typically bulky, expensive and difficult to mount to multiple containers. Since container come in a variety of shapes and sizes, it is important that the locking device be sized and shaped to be retro fit onto a variety of existing containers. Moreover, the locking device must be able to withstand the rigors of everyday, outdoor use in the waste environment.

The need therefore exists for an automatic locking device that improves upon prior automatic locking devices and solves the problems inherent in known automatic locking devices.

SUMMARY OF THE INVENTION

According to a first aspect of the invention, there is provided a locking device for a container having a hinged lid. The locking device comprises a base unit including a base member adapted to be fixed to the container and a pinion member non-movably attached to the base member, and a pivoting unit pivotally mounted to the base unit. The pivoting unit includes a lock casing defining a cavity housing a locking mechanism for rotation about the base unit and the pinion member. The locking mechanism comprises a locking member pivotally mounted to the lock casing, a sliding member reciprocatingly and slidingly movable between the locking member and the pinion member within the cavity in the lock casing. The sliding member drivingly and positively engages the pinion member so that the rotational movement of the sliding member relative to the pinion member causes the linear displacement of the sliding member relative to the pinion member. The locking member is pivotally movable between a blocking position preventing the movement of the sliding member relative the pinion member so as to prevent relative movement between the pivoting unit and the base unit, and a release position permitting the movement of the sliding member relative the pinion member so as to permit relative movement between the pivoting unit and the base unit.

According to a second aspect of the invention, a locking device is provided for a container having a hinged lid and a locking bar preventing opening of the hinged lid. The locking device comprises a pinion member being adapted to be fixed to the container, and a locking mechanism disposed within a lock casing. The pinion member includes gear teeth along at least a portion of a perimeter thereof. The locking mechanism comprises a locking member pivotally mounted to the lock casing, a sliding member reciprocatingly and slidingly movable between the locking member and the pinion member within the cavity in the lock casing. The sliding member has a rack portion with gear teeth in mesh with the gear teeth of the pinion member so that the rotational movement of the sliding member relative to the pinion member causes the linear displacement of the sliding member relative to the pinion member. The locking member has an arcuate stop surface of a distal end of the locking member provided to engage and disengage an arcuate surface of the sliding member relative the pinion member. The locking member is pivotally movable relative to the sliding member between a blocking position in which the arcuate stop surface of the locking member engages the arcuate surface of the sliding member thereby preventing relative movement between the lock housing and the sliding member, and a release position when the container, and thus the locking member, is tilted, permitting relative movement between the lock housing and the sliding member as the arcuate stop surface of the locking member moves away from the arcuate surface of the sliding member.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Other objects and advantages of the present invention will become apparent from a study of the following specification when viewed in light of the accompanying drawings, wherein.

DETAILED DESCRIPTION OF PREFERRED EMBODIMENTS

Figure 1:
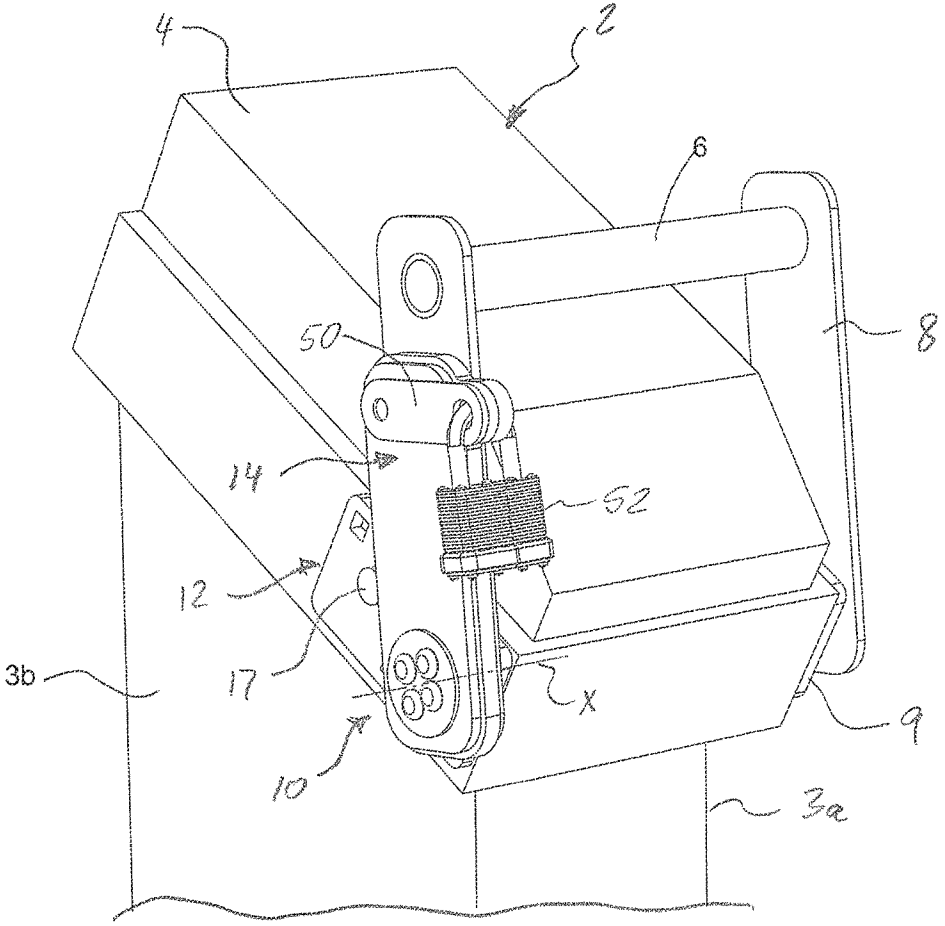
FIG. 1 is a perspective view from a left side of a waste container in an upright position with a slanted lid in a closed position and a locking device according to an exemplary embodiment of the present invention shown in a closed position with a padlock.

The exemplary embodiment of the present invention will now be described with the reference to accompanying drawings. The following description of the preferred embodiment is merely exemplary in nature and is in no way intended to limit the invention, its application, or uses.

For purposes of the following description, certain terminology is used in the following description for convenience only and is not limiting.

The characterizations of various components and orientations described herein as being "vertical", "horizontal", "upright", "right", "left", "side", "top", or "bottom" designate directions in the drawings to which reference is made and are relative characterizations only based upon the particular position or orientation of a given component as illustrated. These terms shall not be regarded as limiting the invention. The words "downward" and "upward" refer to position in a vertical direction relative to a geometric center of the apparatus of the present invention and designated parts thereof. The terminology includes the words above specifically mentioned, derivatives thereof and words of similar import. Additionally, the words "a" or "an" as used in the claims mean "at least one."

Figure 2:
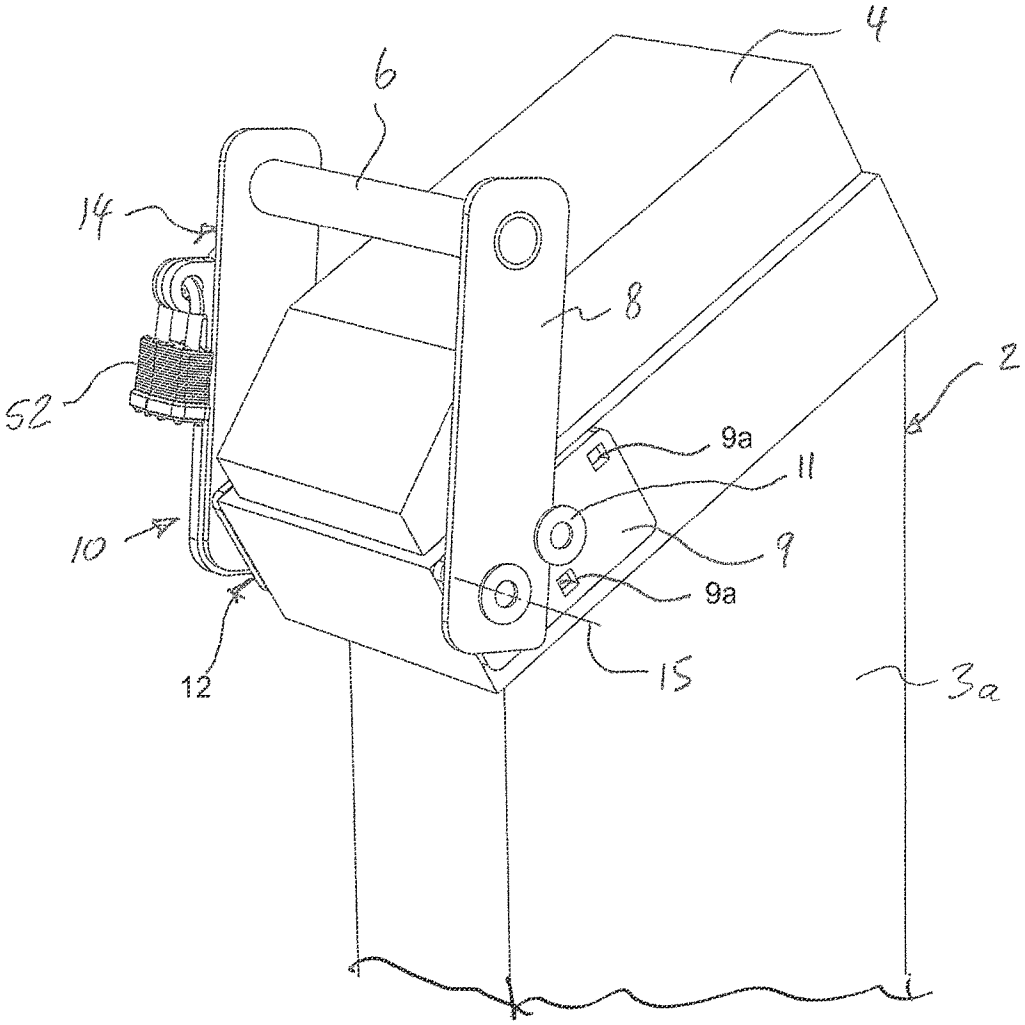
FIG. 2 is a perspective view of the waste container of FIG. 1 from a right side thereof.

FIGS. 1 and 2 of the drawings illustrates a conventional waste or storage container 2, such as a trash collector or dumpster, having at least one slanted hinged lid 4, a locking device 10 according to an exemplary embodiment of the present invention and a manual (or locking) bar 6 extending substantially across the length of the waste container 2, as illustrated in FIGS. 1 and 2. The waste container 2, as illustrated in FIGS. 1-4, is generally an industrial-type dumpster used for retaining, storing, and eventually disposing of refuse (waste), such as glass fragments produced during the manufacture of automotive glass. The container 2 may be tilted or otherwise pivoted from an upright storage position (wherein the waste container 2 is sitting generally horizontally) (shown in FIGS. 1-2) to a tilted or dumping position (shown in FIG. 4).

The locking device 10 is provided for locking and unlocking the waste container 2 to prevent the inadvertent dumping of its contents. The locking bar 6 extends between the locking device 10 at one end and a pivoting arm 8 at the other end thereof. The pivoting arm 8 is pivotally mounted to a support member 9 non-movably fastened to the right side wall 3*a* of the waste container 2 by any appropriate means known in the art, while the locking device 10 is mounted to a left side wall 3*b* thereof, as best shown in FIGS. 1-4. The support member 9 is in the form of a flat metal plate having at least two holes 9*a* therethrough and fastened to the right side wall 3*a* of the waste container 2 by threaded fasteners (not shown in detail) extending through the holes 9*a*, as best shown in FIGS. 2 and 5A.

The locking device 10 according to the exemplary embodiment of the present invention, as illustrated in detail in FIGS. 6-11, comprises a base unit 12 fixed to the left side wall 3*b* of the waste container 2, and an elongated pivoting unit 14 pivotally mounted to the base unit 12 for pivotable movement relative to the base unit 12 about a pivot axis X.

Herein, the axial and radial orientations are considered with respect to the pivot axis X of the locking device 10. The relative terms such as "axially," "radially," and "circumferentially" are with respect to orientations parallel to, perpendicular to, and around the pivot axis X, respectively. The relative terms such as "inwardly" and "outwardly" and derivatives thereof are with respect to orientations toward or away from the pivot axis X, respectively.

Figure 21:
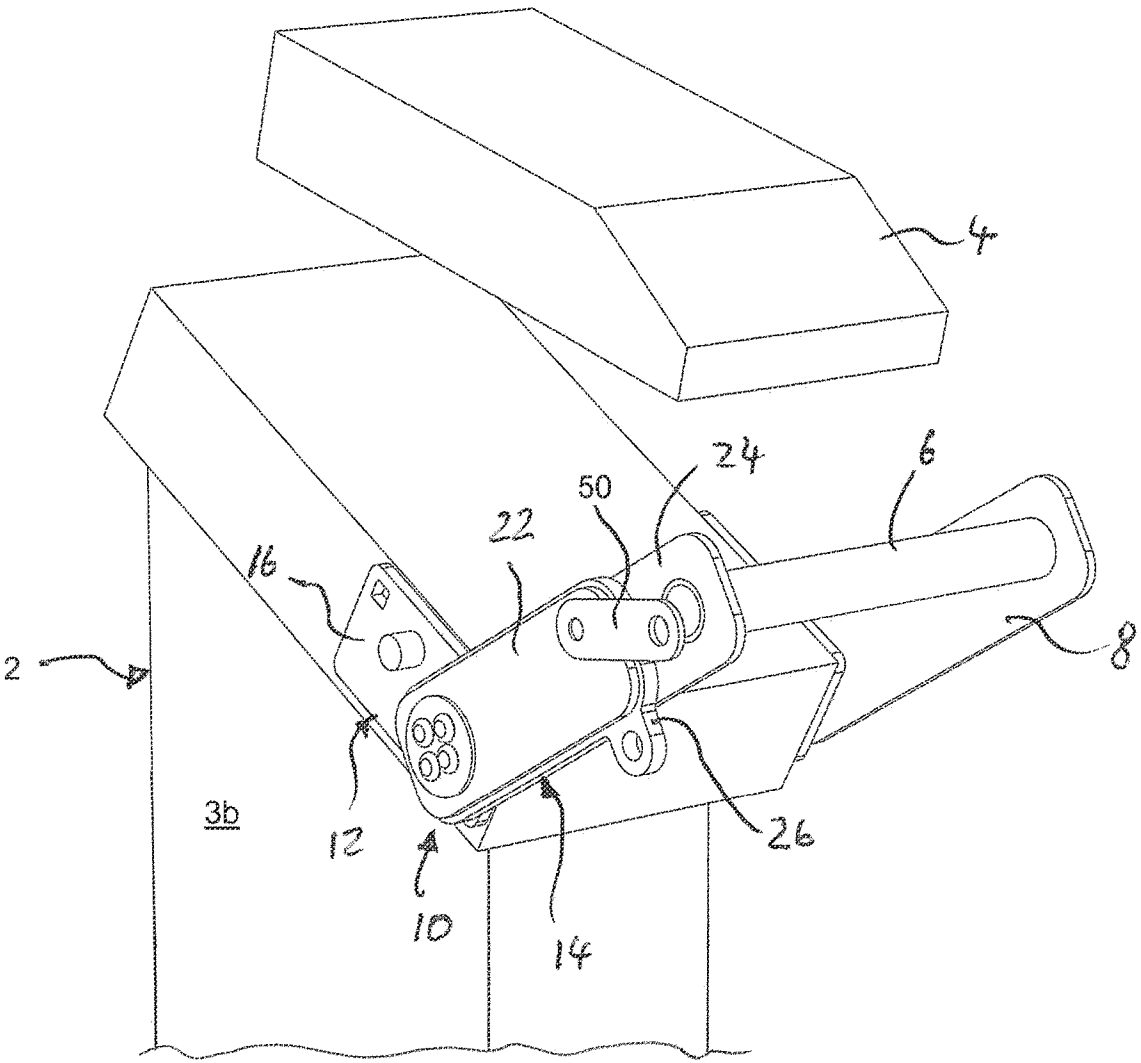
FIG. 21 is a perspective view of the waste container in the upright position with open lid and the locking device according to the exemplary embodiment of the present invention shown in the open position without the padlock and with the manual release lever in the override position.
Figure 22:
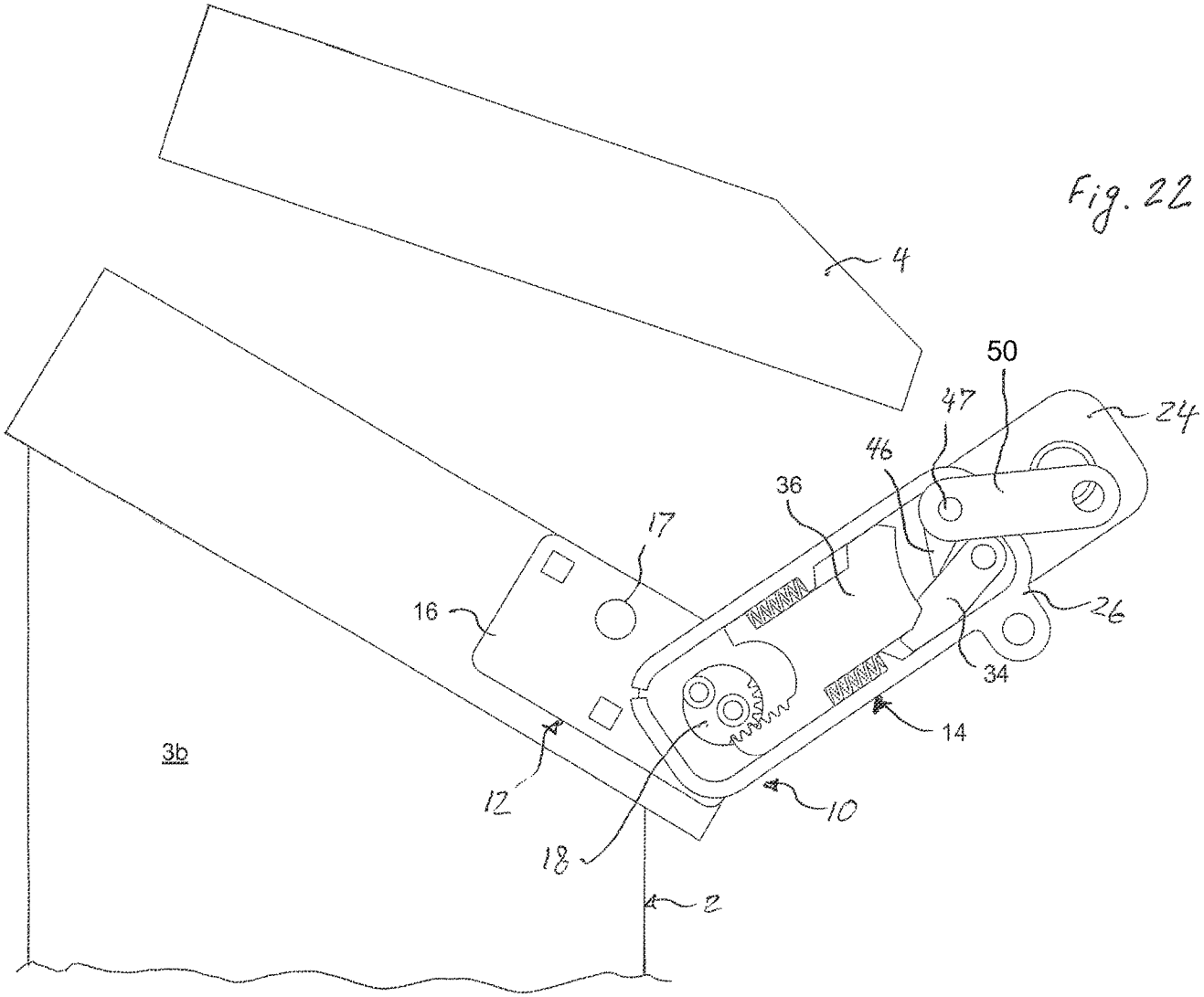
FIG. 22 is a side view of the waste container in the upright position with open lid and the locking device according to the exemplary embodiment of the present invention in the open position without the padlock and with the manual release lever in the override position, showing the locking mechanism in the release position, without the cover plate and the outer plate.

The locking bar 6 is secured to the pivoting unit 14 at a distal end thereof so as to extend substantially across the length of the waste container 2, as illustrated in FIGS. 1 and 2. The pivoting unit 14, the pivoting arm 8, and the locking bar 6 movable therewith are provided to translate from a closed position (shown in FIGS. 1-2) of the waste container 2 wherein the locking bar 6 extends over the hinged lid 4 of the waste container 2 so as to prevent opening of the waste container 2, as illustrated in FIGS. 1-2, and an open position (shown in FIG. 4) wherein the locking bar 6 is horizontally spaced away from the hinged lid 4 of the waste container 2 so as to allow the opening of the hinged lid 4 of the waste container 2, as illustrated in FIGS. 4, 21 and 22.

The base unit 12, as illustrated in detail in FIGS. 6-10, includes a base member (or base plate) 16 non-movably fastened to the left side wall 3*b* of the waste container 2 by any appropriate means known in the art, and a pinion member 18 non-movably attached (i.e., fixed) to the base member 16. As illustrated in FIGS. 8-11, the pinion member 18 includes gear teeth 20 along at least a portion of a perimeter thereof. According to an exemplary embodiment of the present invention, the gear teeth 20 are formed on a sector of the pinion member 18. In other words, the gear teeth 20 partially, i.e., not entirely, encircle the pinion member 18. Alternatively, the gear teeth 20 can be formed on an entire perimeter of the pinion member 18.

Figure 18:
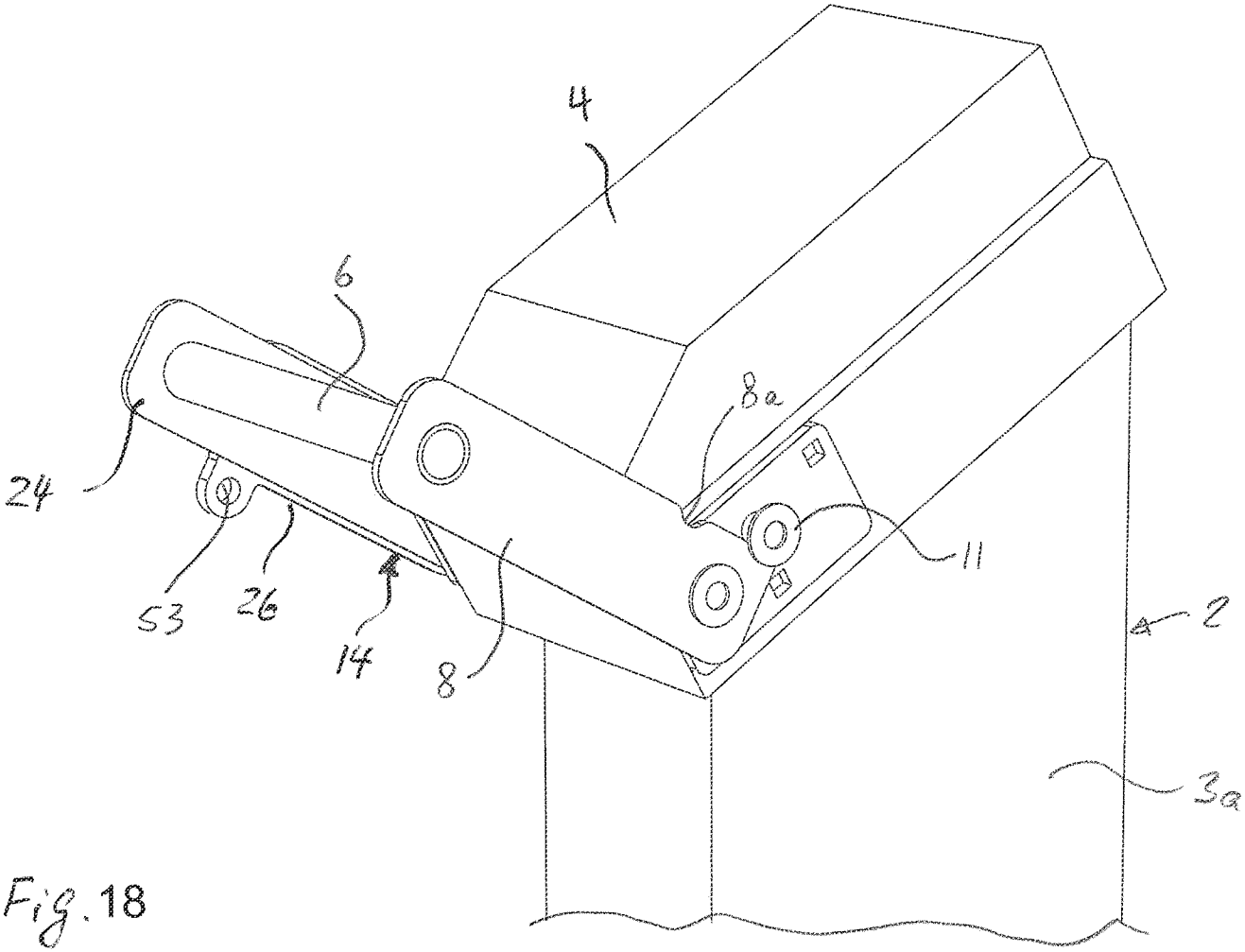
FIG. 18 is a perspective view of the waste container of FIG. 17 from a right side thereof.
Figure 19:
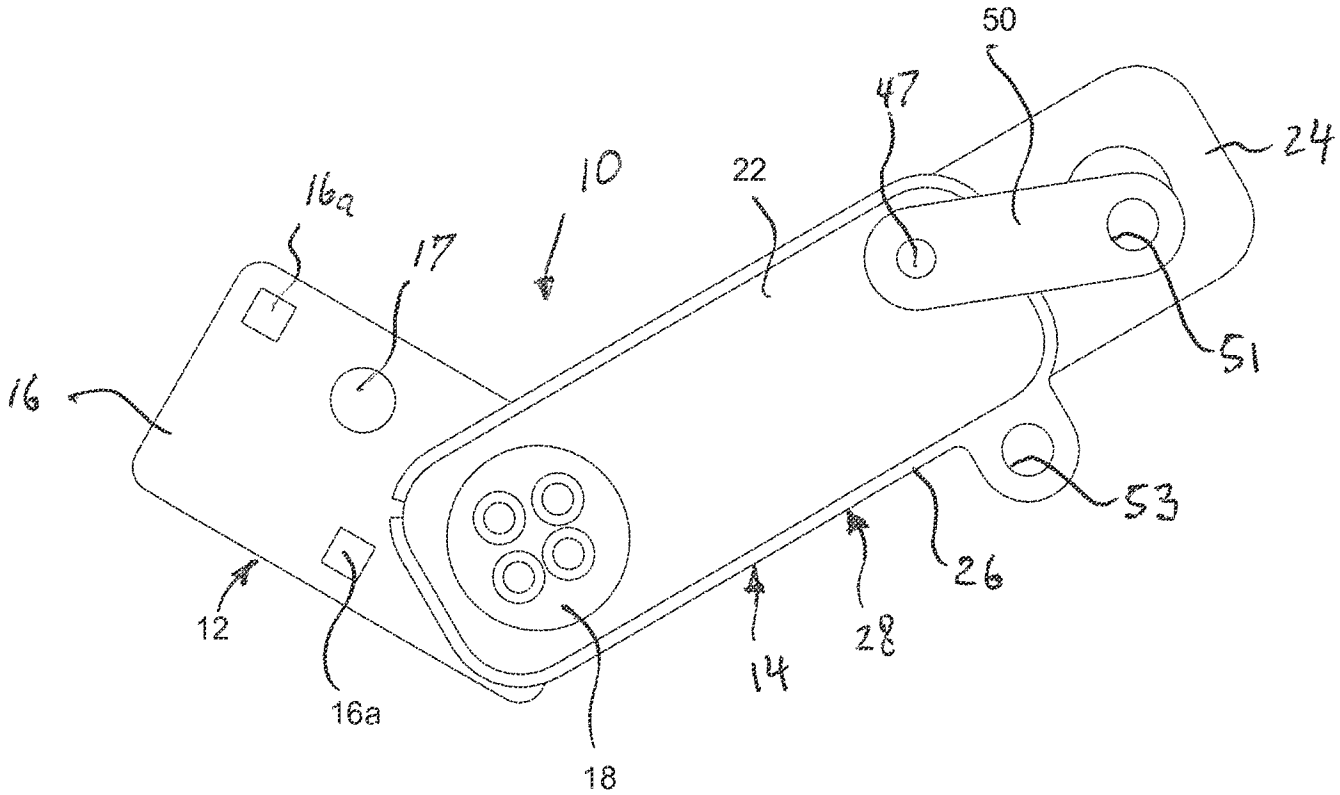
FIG. 19 is a side view of the locking device according to the exemplary embodiment of the present invention in the open position without the padlock and with the manual release lever in the override position.

According to an exemplary embodiment of the present invention, as illustrated in FIGS. 6-10, the base member 16 is in the form of a substantially flat metal plate having at least two holes 16*a* therethrough and fastened to the left side wall 3*b* of the waste container 2 by threaded fasteners (not shown in detail) extending through the holes 16*a*. As further illustrated in FIGS. 1 and 6-9, the base unit 12 further includes a stop member 17 fixed (i.e., non-moveably secured) to the base member 16 and axially extending therefrom for limiting counterclockwise rotation of the pivoting unit 14 about the pivot axis X. Similarly, as best shown in FIG. 2, the support member 9 further includes a stop member 11 fixed (i.e., non-moveably secured) to the support member 9 and axially extending therefrom for limiting counterclockwise rotation of the pivoting arm 8 about the pivot axis X by engaging a lower (or proximal) end of the pivoting arm 8 as shown in FIG. 18. As further illustrated in FIG. 18, the pivoting arm 8 has a concave support recess 8*a* complementary to a cylindrical outer surface of the stop member 11.

In the exemplary embodiment of the present invention, the pinion member 18 is non-movably attached (i.e., fixed) to the base member 16 of the base unit 12. Moreover, the pinion member 18 is substantially coaxial with the pivot axis X. In the exemplary embodiment of the present invention best shown in FIGS. 7-12, the pinion member 18 is in the form of a flat metal (or of any other appropriate material) plate fixed to the base member 16 of the base unit 12 and having the gear teeth 20 along a portion of a perimeter thereof.

Figure 3:
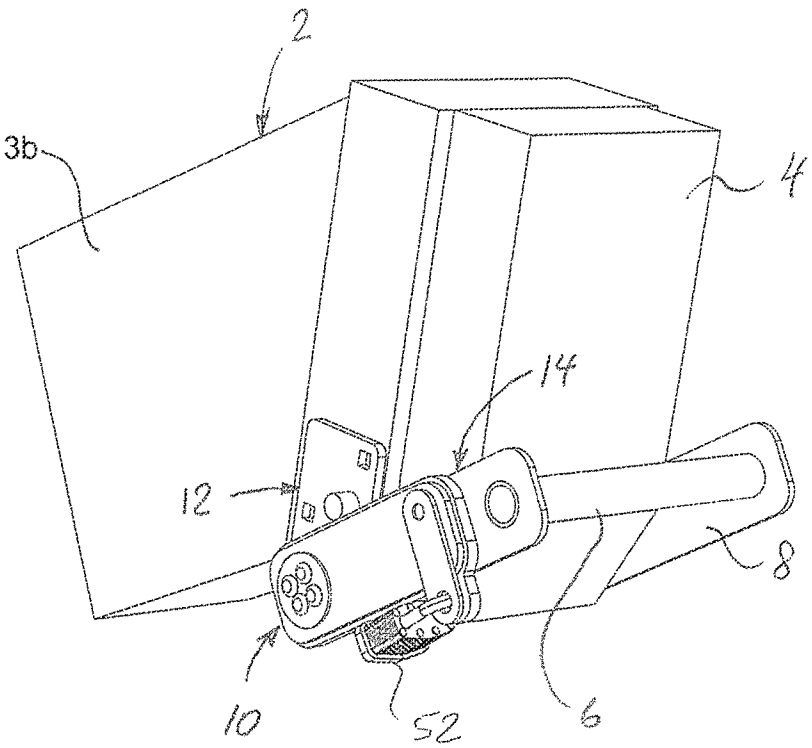
FIG. 3 is a perspective view of the waste container in a tilted position with closed lid and the locking device according to the exemplary embodiment of the present invention shown in the closed position with the padlock.
Figure 4:
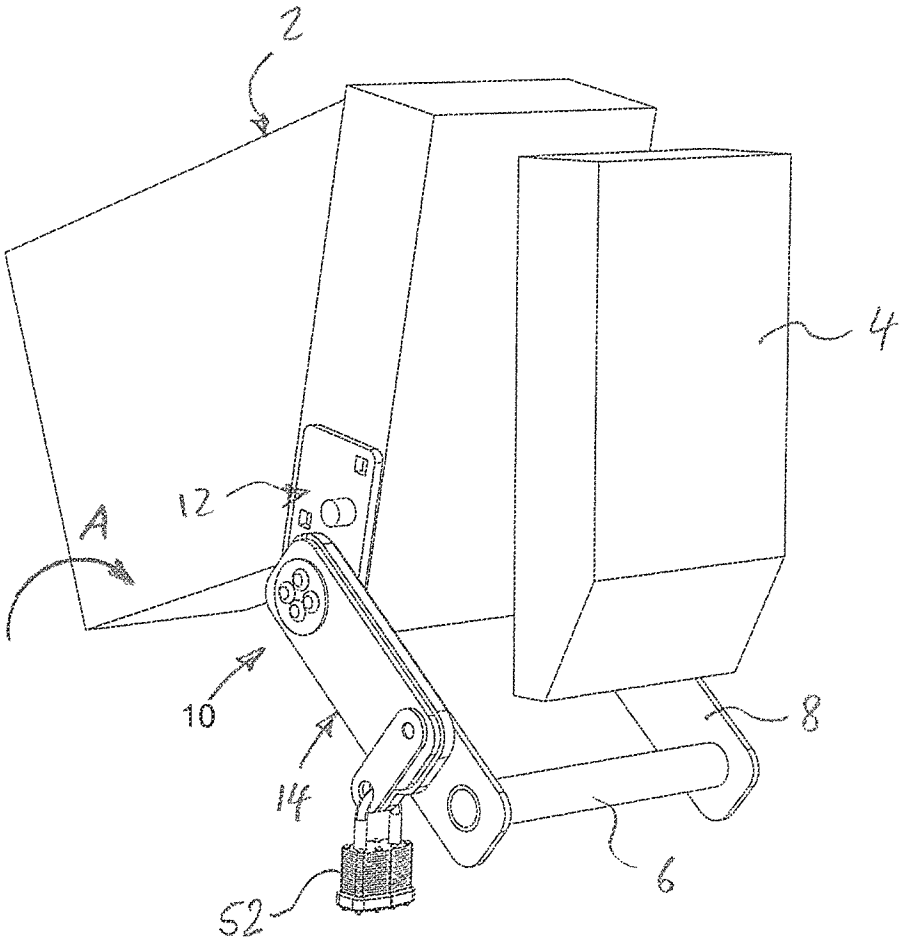
FIG. 4 is a perspective view of the waste container in the tilted position with open lid and the locking device according to the exemplary embodiment of the present invention shown in an open position with the padlock.
Figure 5A:
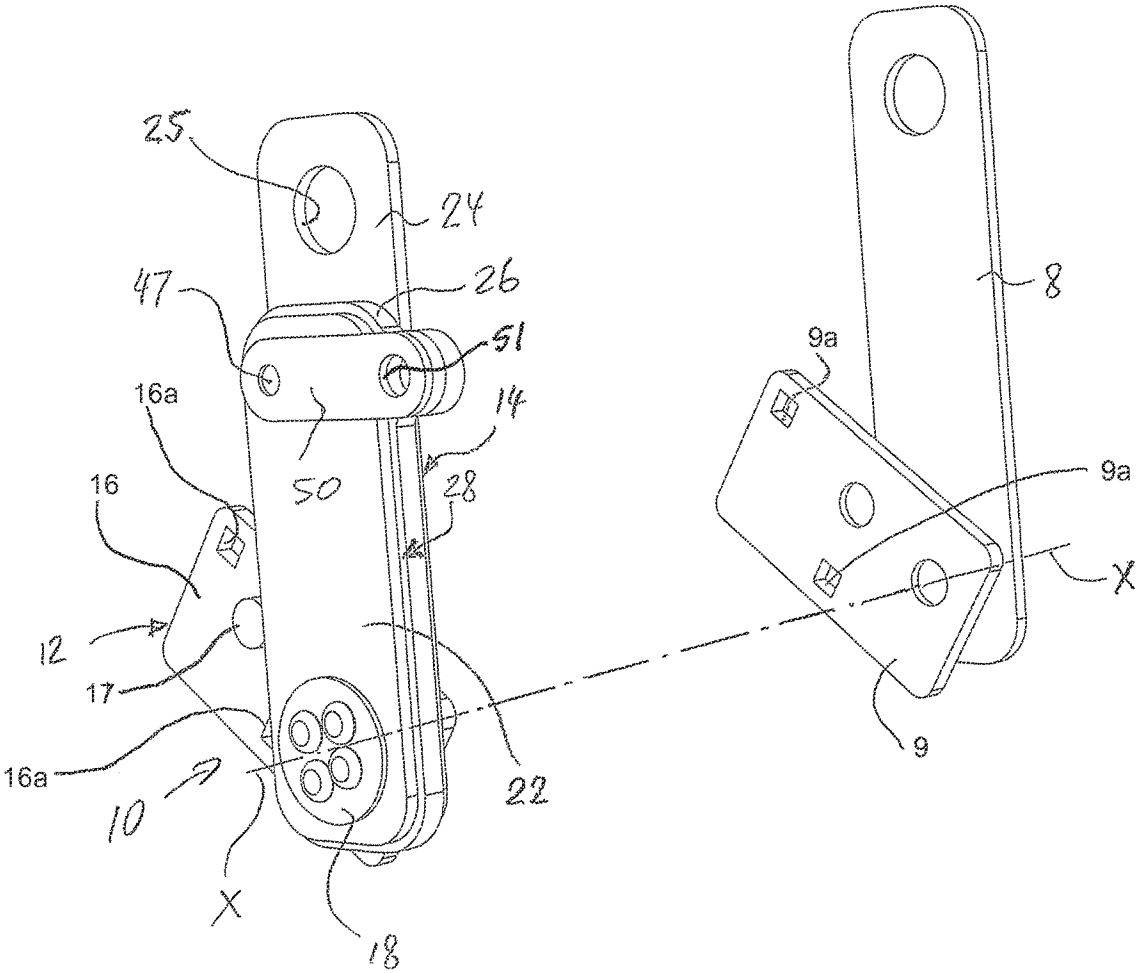
FIG. 5A is perspective views of the locking device according to the exemplary embodiment of the present invention, shown in the closed position without the padlock, and a pivoting arm.
Figure 10:
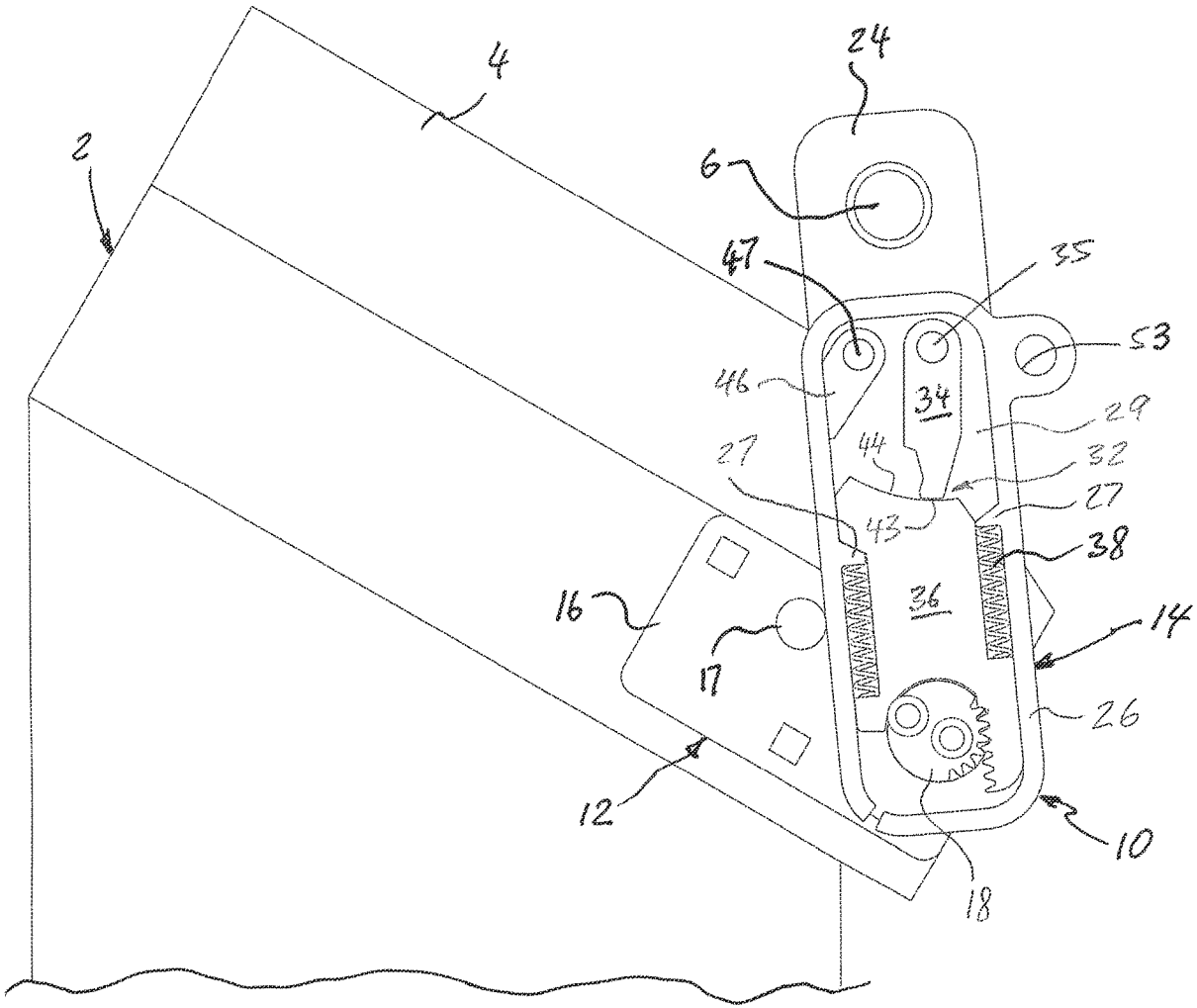
FIG. 10 is a side view of the waste container in the upright position with the closed slanted lid and the locking device according to the exemplary embodiment of the present invention in the closed position, showing the locking mechanism in a blocking position, without the cover plate and the outer plate.

The pivoting unit 14 comprises an outer (or cover) plate 22 (shown in FIGS. 6 and 8-11), an inner (extended) plate 24 and a hollow plate-shaped intermediate member 26 (shown in FIGS. 3, 4 and 10). The inner plate 24 is pivotally mounted to the base member 16 and is non-movably attached (i.e., fixed) to the outer plate 22 through the intermediate member 26. In other words, the intermediate member 26 is sandwiched between the inner plate 24 and the outer plate 22 so as to define an integral lock casing 28 defining a cavity 29 therein (as shown in FIGS. 7, 8 and 10-12). A washer 19 is disposed outside the outer plate 22, which is, thus, disposed between the pinion member 18 and the washer 19. The washer 19 is secured to the pinion member 18 by means of one or more fasteners 21.

Figure 7:
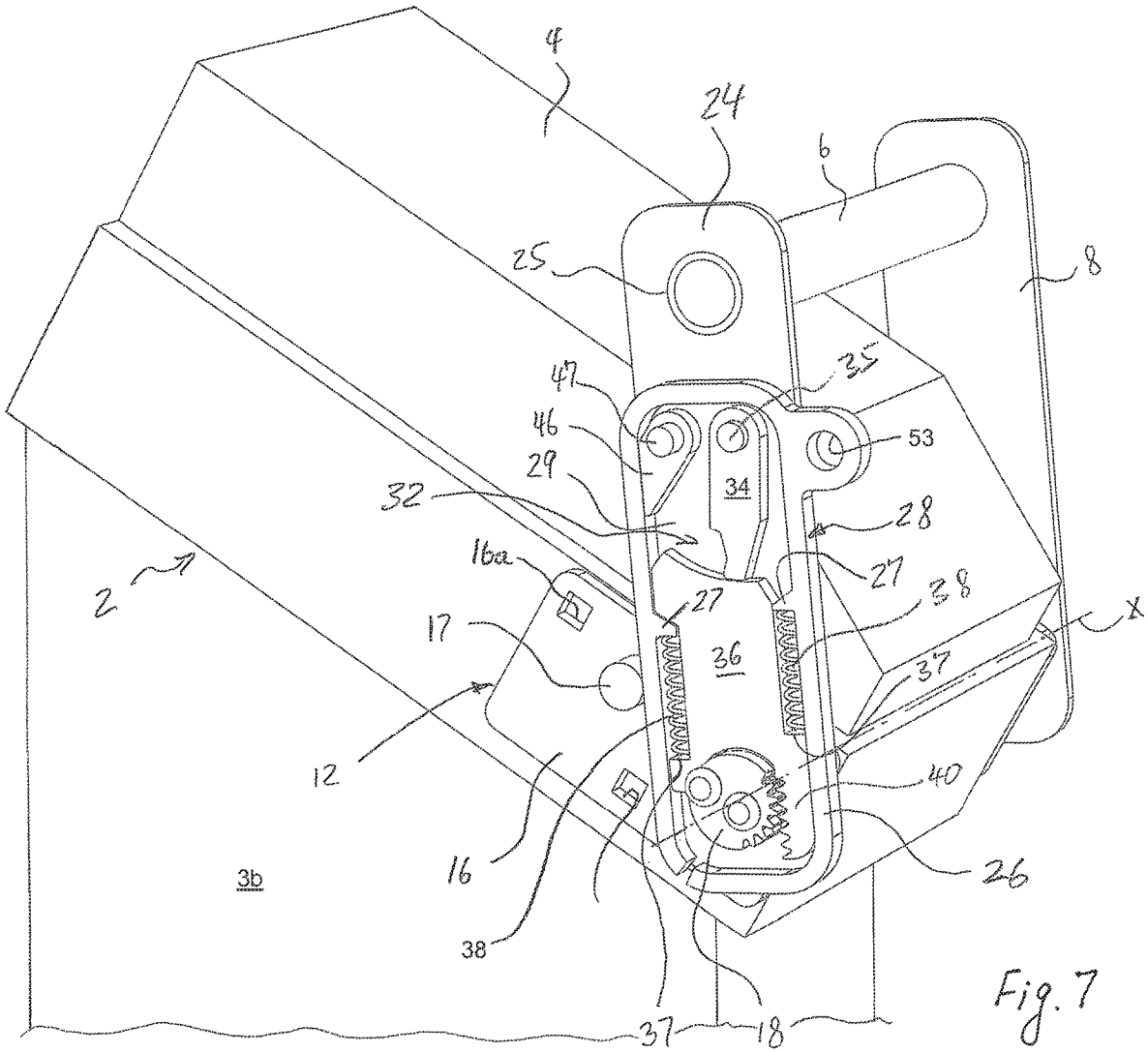
FIG. 7 is a perspective view of the waste container in the upright position with closed lid and the locking device according to the exemplary embodiment of the present invention including a pivoting unit without a cover plate and the padlock.

As further illustrated in FIGS. 1-4, 7 and 21, the locking bar 6 is mounted to the inner plate 24 by any appropriate means known in the art to extend over the hinged lid 4 of the waste container 2 in the closed position thereof, as shown in FIGS. 1-2 and 7. Specifically, the inner plate 24 includes a circular opening 25 provided for mounting the locking bar 6 of the waste container 2 to the inner plate 24 of the locking device 10. The inner plate 24 is pivotally mounted to the base member 16 for rotation about the pinion member 18. Thus, the pivoting unit 14 is mounted to the base unit 12 for pivoting movement between a closed position (shown in FIGS. 1-2) and an open position (shown in FIGS. 4 and 21). The concave support recess 8*a* of the pivoting arm 8 engages the outer surface of the stop member 11 so that the pivoting arm 8 rests on the stop member 11 when the pivoting unit 14 is in the closed position (shown in FIGS. 1-2).

As best shown in FIG. 18, a proximal (or bottom) end of the pivoting arm 8 engages the outer surface of the stop member 11 when the pivoting unit 14 is in the open position (shown in FIGS. 4, 13 and 17-22) so as to prevent the further pivoting movement of the pivoting unit 14 relative to the base unit 12. In other words, the stop member 11 blocks (prevents) the pivoting movement of the pivoting unit 14 relative to the base unit 12 both in the closed and open position of the pivoting unit 14.

Figure 8:
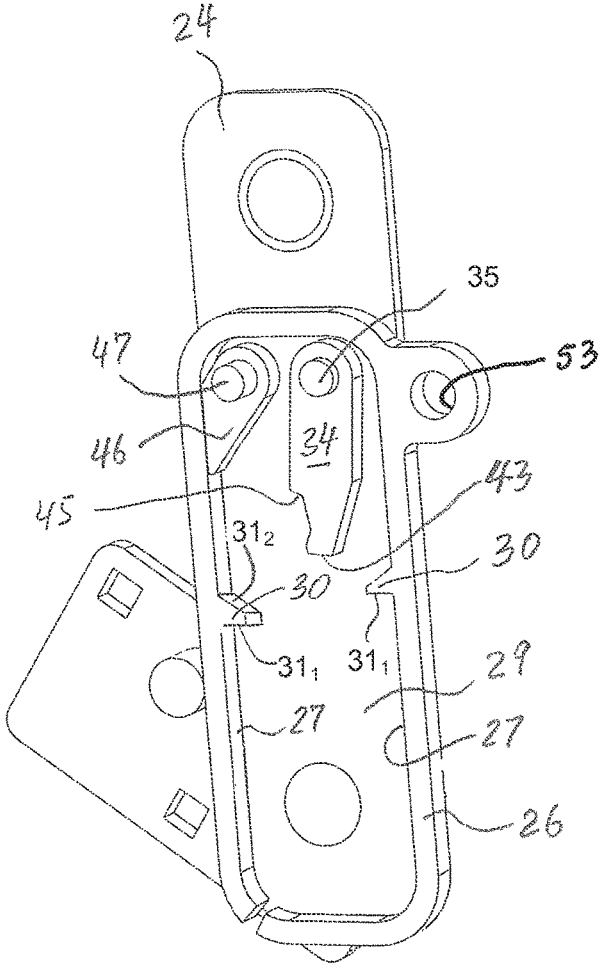
FIG. 8 is a perspective view of the pivoting unit without the cover plate, biasing springs and a sliding member.
Figure 9:
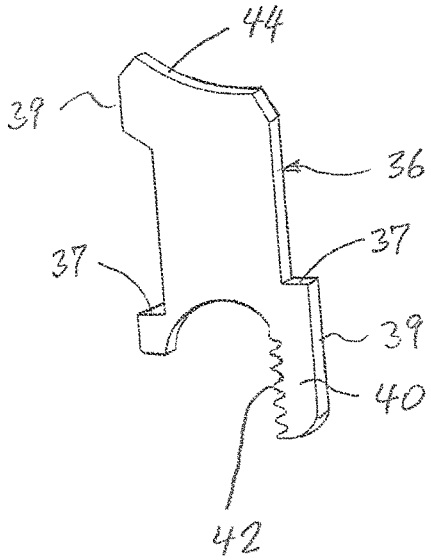
FIG. 9 is a perspective view of the sliding member of the pivoting shown in FIG. 7.

The pivoting unit 14 further includes an automatic, pivoting locking mechanism 32 disposed in the cavity 29 of the lock casing 28. Thus, the locking mechanism 32 is adapted to rotate (pivot) with the pivoting unit 14 of the waste container 2. The locking mechanism comprises a locking member 34 pivotally mounted to the lock casing 28, a sliding member 36 reciprocatingly and slidingly movable between the locking member 34 and the pinion member 18 within the cavity 29 in the lock casing 28, one or more biasing springs 38, and a pivot (or hinged) lever 46 pivotally mounted within the lock casing 28. As best shown in FIG. 8, a thickness of the locking mechanism 32, i.e., of each of the locking member 34, the sliding member 36, the biasing springs 38 and the pivot lever 46, is substantially equal to or slightly less than a thickness of the intermediate member 26. Such an arrangement allows the locking member 34, the sliding member 36, the biasing springs 38 and the pivot lever 46 to be moveably disposed within the cavity 29 of the lock casing 28 defined by the hollow intermediate member 26 sandwiched between the inner plate 24 and the outer plate 22.

The locking member 34 is pivotally mounted to a pivot shaft 35, while the pivot lever 46 is non-rotatably mounted (or fixed) to a pivot shaft 47. The pivot shaft 35 and the pivot shaft 47 are spaced from each other and extend between the inner and outer plate 24 and 22, respectively.

The biasing springs 38 are configured for biasing the sliding member 36 in the direction away from the locking member 34 and toward the pinion member 18. Each of the biasing springs 38 is disposed between the intermediate member 26 of the lock casing 28 and the sliding member 36. The intermediate member 26 of the lock casing 28 includes two opposite support flanges 30 each axially extending into the cavity 29. Moreover, each of the support flanges 30 has a spring support surface $\mathbf{31}_1$ and a stop surface $\mathbf{31}_2$. Each of the biasing springs 38 is in the form of a coil spring disposed between the spring support surface $\mathbf{31}_1$ of the intermediate member 26 and a spring support surface 37 of the sliding member 36 disposed opposite to the spring support surface $\mathbf{31}_1$. As further illustrated, the stop surface $\mathbf{31}_2$ of one of the support flanges 30 of the intermediate member 26 of the lock casing 28 is configured to limit the sliding movement of the sliding member 36 toward the pinion member 18.

The sliding member 36 has a rack (i.e., straight) portion 40 having gear teeth 42, which are in mesh with the gear teeth 20 of the pinion member 18. Accordingly, when the pivoting unit 14 with the locking bar 6 pivotally rotate relative to the waste container 2, the sliding member 36, not only rotates relative to the pinion member 18, but also is slidingly displaced in the direction away from the pinion member 18 because the gear teeth 42 of the rack portion 40 of the sliding member 36 are engaged with and move relative to the gear teeth 20 of the pinion member 18.

Moreover, a distal end of the sliding member 36 adjacent to the locking member 34 has an arcuate (concave) surface 44. It will be appreciated that the arcuate surface 44 of the sliding member 36 is complementary to an arcuate (convex) stop surface 43 on a distal end of the locking member 34. In other words, a radius of curvature of the arcuate stop surface 43 of the locking member 34 is complementary to (matches) a radius of curvature of the arcuate surface 44 of the sliding member 36.

The sliding member 36 has opposite, substantially parallel side surfaces 39 slidingly engaging opposite inner surfaces 27 of the intermediate member 26. The inner surfaces 27 of the intermediate member 26 39 are facing each other.

According to the present invention, the locking member 34 is adapted to translate from a first blocking position (shown in FIG. 10) preventing pivoting movement of the pivoting unit 14 relative to the base unit 12 (thus, the locking bar 6 relative to the waste container 2) to a second release position (shown in FIG. 12) permitting pivoting movement of the pivoting unit 14 relative to the base unit 12 (thus, the locking bar 6 relative to the waste container 2). In other words, the locking member 34 translates from the first blocking position, preventing the linear displacement of the sliding member 36 relative the pinion member 18, to the second release position permitting the movement of the sliding member 36 relative the pinion member 18.

The locking device 10 is mounted to the waste container 2 with the slanted lid 4 so that when the waste container 2 is in its upright storage position, locking member 34 is maintained in a far left position thereof (shown in FIG. 10) by gravity. It will be appreciated that the radius of curvature of the arcuate stop surface 43 of the locking member 34 is substantially equal to (i.e., equal to or slightly bigger than) a distance between the arcuate surface 44 of the sliding member 36 and an axis of the pivot shaft 35 of the locking member 34 when the sliding member 36 engages the stop surface $\mathbf{31}_2$ of the lock casing 28. Moreover, a length of the arcuate surface 44 of the sliding member 36 is such that the locking device 10 according to the exemplary embodiment of the present invention is such that the locking device 10 can be used with both waste containers with slanted lid (as shown in FIG. 10) and waste containers with horizontal lids (as shown in FIG. 11).

Figure 11:
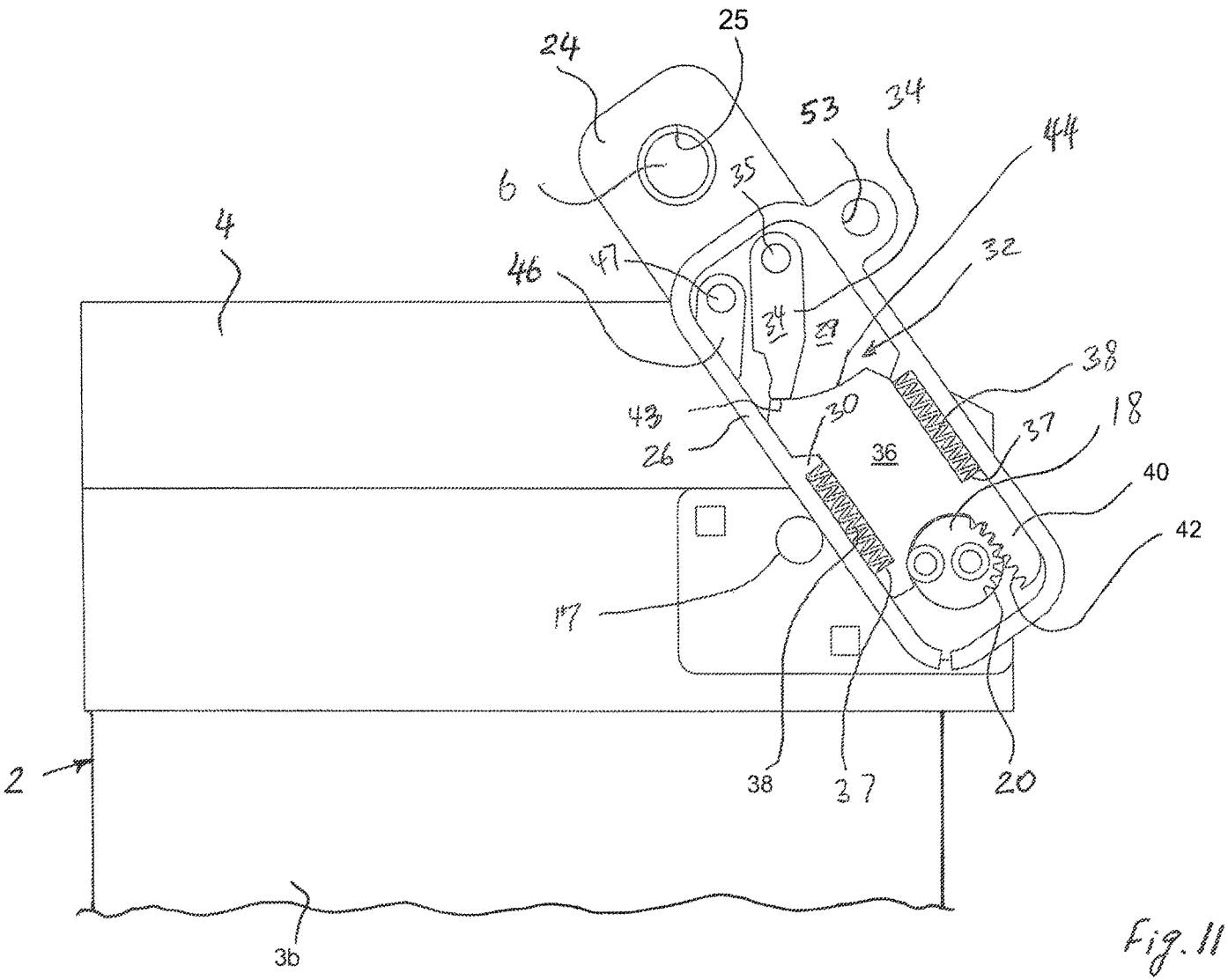
FIG. 11 is a side view of a waste container with a horizontal lid in an upright position with closed horizontal lid and the locking device according to the exemplary embodiment of the present invention in the closed position, showing the locking mechanism in a blocking position, without the cover plate and the outer plate.
Figure 12:
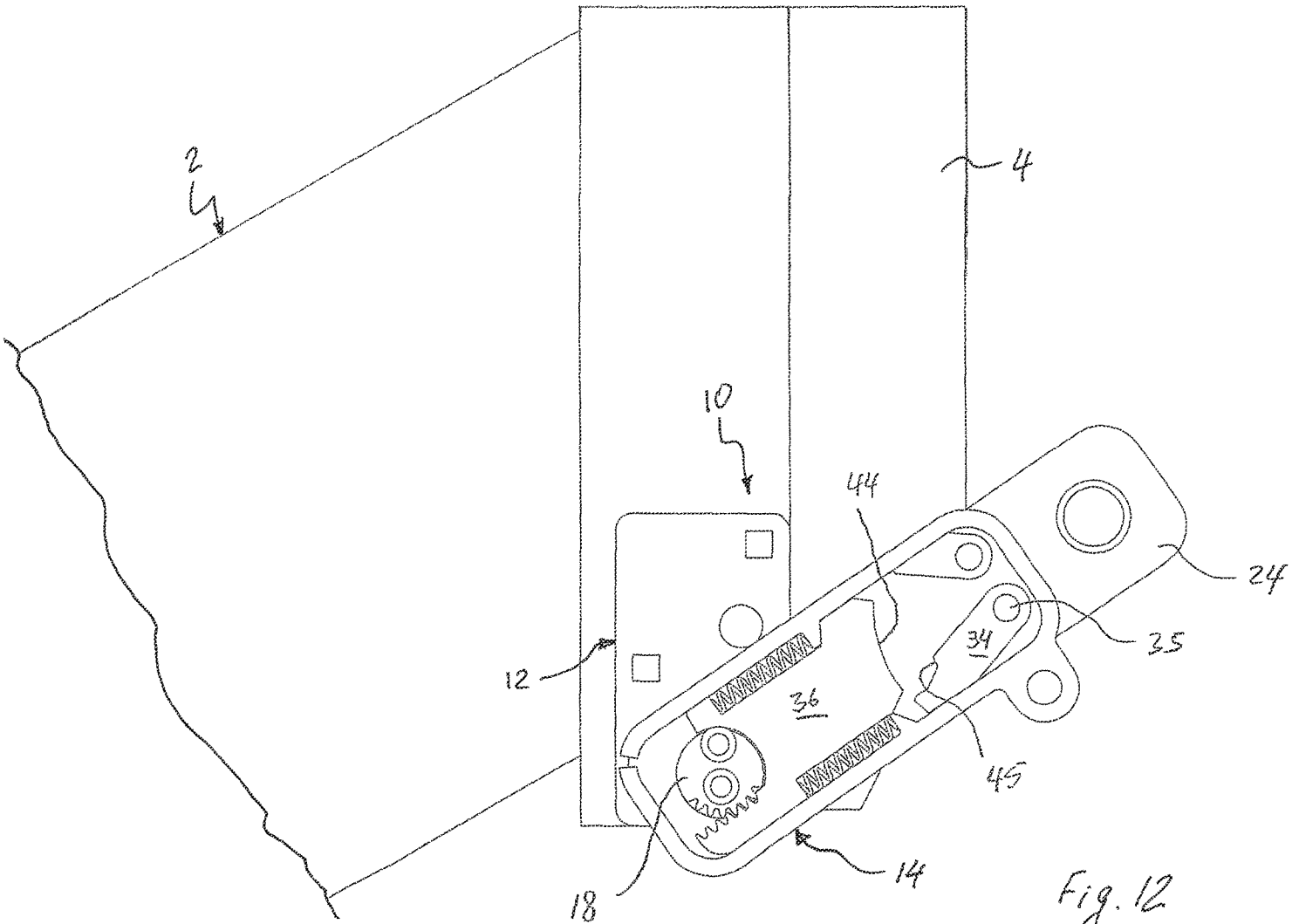
FIG. 12 is a side view of the waste container in the tilted position with closed lid and the locking device according to the exemplary embodiment of the present invention in the closed position, showing the locking mechanism in a release position, without the cover plate and the outer plate.
Figure 13:
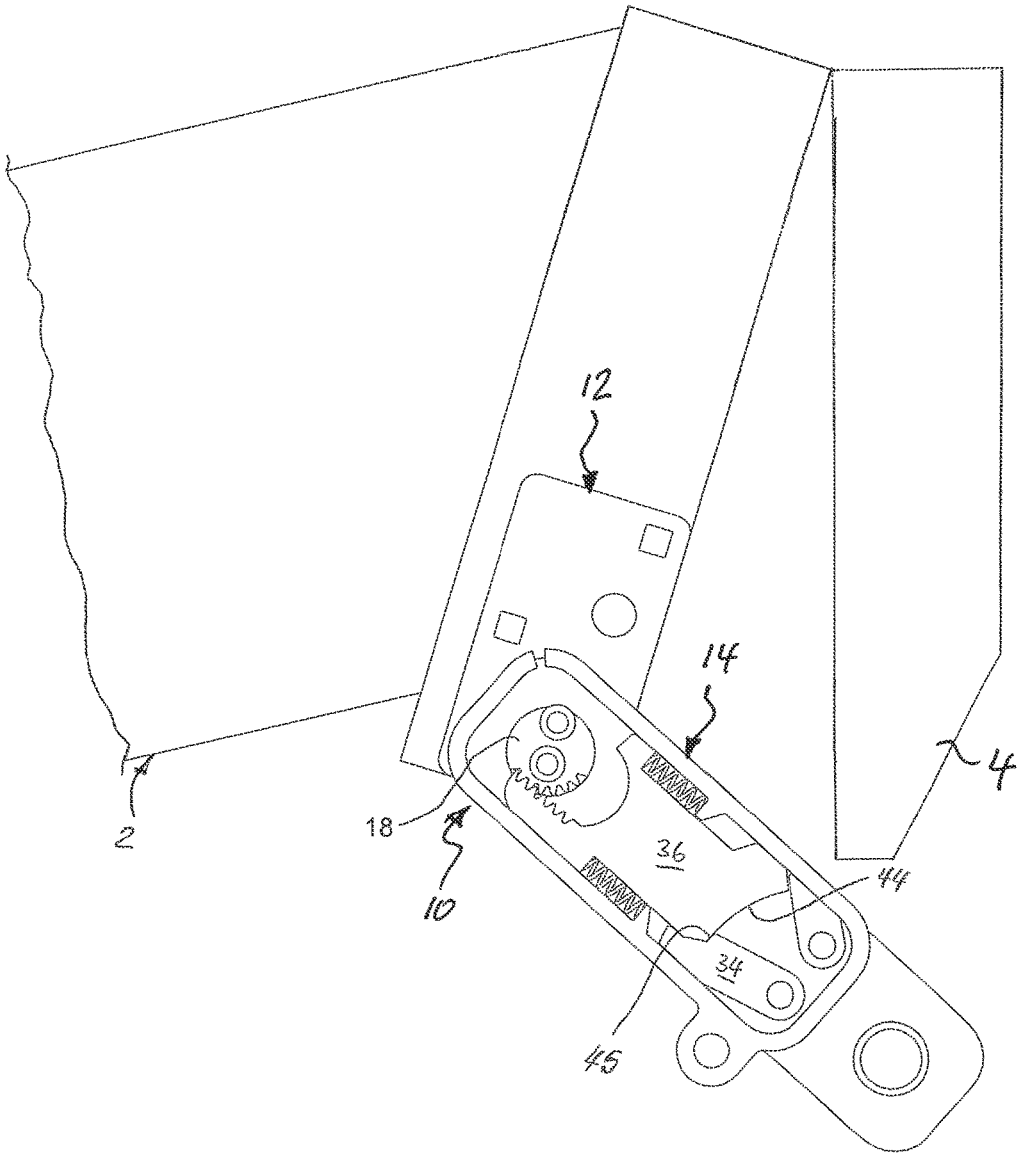
FIG. 13 is a side view of the waste container in the tilted position with open lid and the locking device according to the exemplary embodiment of the present invention in the open position, showing the locking mechanism in a release position, without the cover plate and the outer plate.

Consequently, in the far left position of the locking member 34, the arcuate surface 44 of the sliding member 36 engages the arcuate stop surface 43 of the locking member 34, as illustrated in FIGS. 10 and 11. In this position, the locking member 34 blocks (prevents) the sliding linear movement of the sliding member 36 relative to the pinion member 18 and the lock casing 28, thus prevents the pivoting movement of the pivoting unit 14 relative to the base unit 12. In other words, the locking member 34 is in the first blocking position (shown in FIGS. 10 and 11) and prevents the locking bar 6 from rotating relative to the waste container 2, thus maintaining the locking bar 6 in the closed position. However, by tilting the waste container 2 forwardly, in the direction of arrow A (shown in FIG. 4), so that the locking member 34 rotates about the shaft 35 counterclockwise to the right as shown in FIGS. 12 and 13 within the cavity 29 of the lock casing 28 to its second release position and no longer blocks the sliding member 36 from displacement, thus the pivoting unit 14 from rotating relative to the base unit 12. Thus, in the second release position of the locking member 34, the locking bar 6 can rotate relative to the waste container 2 from the closed position to the open position thereof.

The pivot lever 46 of the locking mechanism 32 is disposed within the lock casing 28 and is pivotally mounted to the outer plate 22 of the pivoting unit 14 through the shaft 47 shown in FIG. 8. Alternatively, the pivot lever 46 may be pivotally mounted to the inner plate 24 of the pivoting unit 14 through the shaft 47. Also, the shaft 47 extends through a hole in the outer plate 22 so that an outer distal end of the shaft 47 extends outside the outer plate 22 of the lock casing 28, as shown in detail in FIG. 6, and is non-rotatably fixed to the pivot lever 46. The outer distal end of the shaft 47 is non-rotatably fixed to a manual release lever 50 disposed outside the lock casing 28. In other words, both the pivot lever 46 and the manual release lever 50 are rotatable relative to the outer plate 22 (i.e., the lock casing 28) of the pivoting unit 14. It will be appreciated that the rotational movement of the manual release lever 50 causes corresponding rotational movement of the pivot lever 46.

As further illustrated in FIGS. 7, 8 and 10, the pivot lever 46 is disposed and is rotationally moveable in the cavity 29 of the lock casing 28 between the inner plate 24 and the outer plate 22 so that a distal end of the pivot lever 46 is located adjacent to a distal end of the locking member 34. The pivot lever 46 has a length such that when the locking member 34 is in the first blocking position, the pivot lever 46 can push and rotate the locking member 34 toward the second release position thereof if rotated counterclockwise (as shown in FIGS. 14-17). Thus, the manual release lever 50 is provided for manually moving the locking member 34 from the blocking position to the release position regardless of a tilt angle of the locking mechanism 32, as the manual release lever 50 is non-rotatably connected to the pivot lever 46. In other words, the pivot lever 46 allows bypassing the gravity operated locking mechanism 32 by rotating the manual release lever 50 by an authorized person.

In order to prevent rotation of the manual release lever 50 relative to the 1 lock casing 28 by an unauthorized person, a padlock 52 (shown in FIGS. 1-4) may be used. Specifically, the padlock 52 locks together the manual release lever 50 and the intermediate member 26 of the lock casing 28 by extending through holes 51 and 53 through the manual release lever 50 and the intermediate member 26, respectively (best shown in FIGS. 6 and 7). It will be appreciated that any type of manual lock device which locks the manual release lever 50 to the lock casing 28 may be employed in order to allow only an authorized person to unlock the manual release lever 50. Thus, the pivot lever 46 has a locked and unlocked position provided by the padlock 52 being placed in the holes 51 and 53 in the manual release lever 50 and the intermediate member 26.

Figure 14:
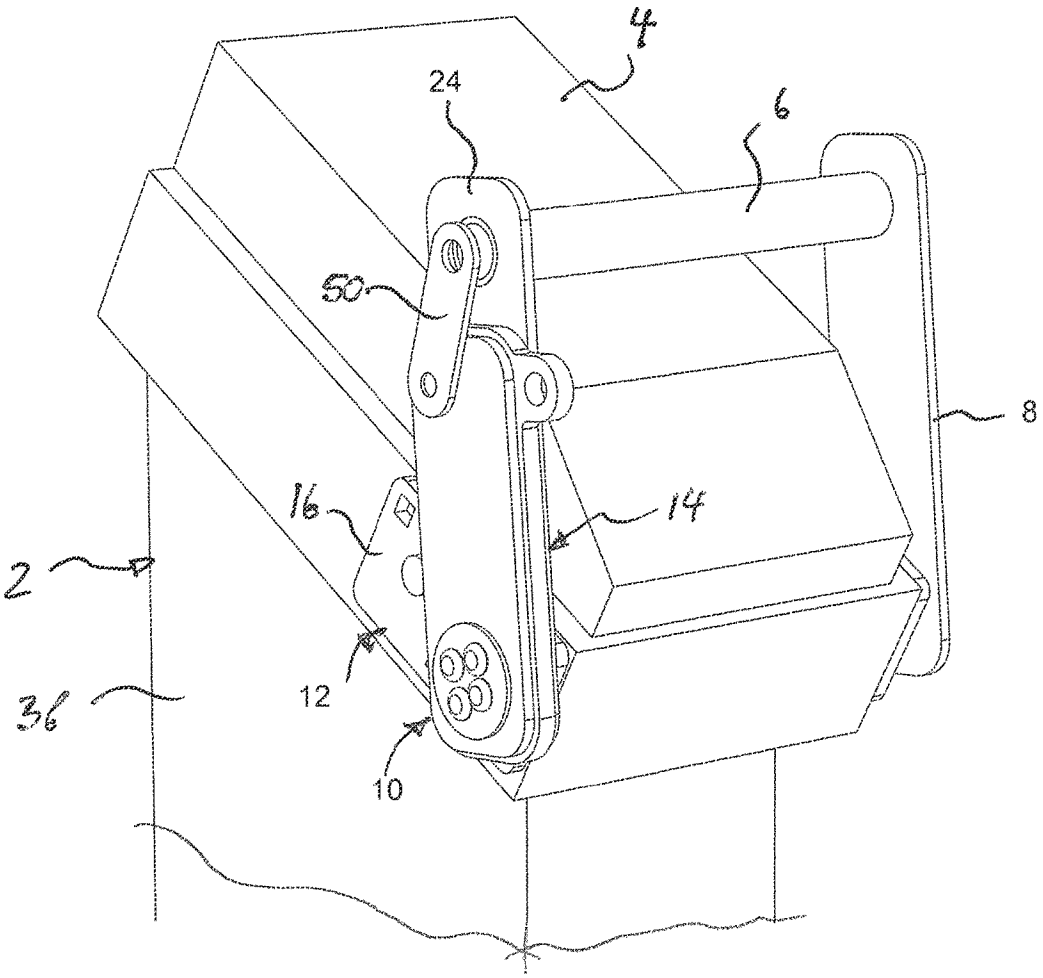
FIG. 14 is a perspective view from a left side of the waste container in the upright position with closed lid and the locking device according to the exemplary embodiment of the present invention shown in the closed position without the padlock and with a manual release lever in an override position.
Figure 15:
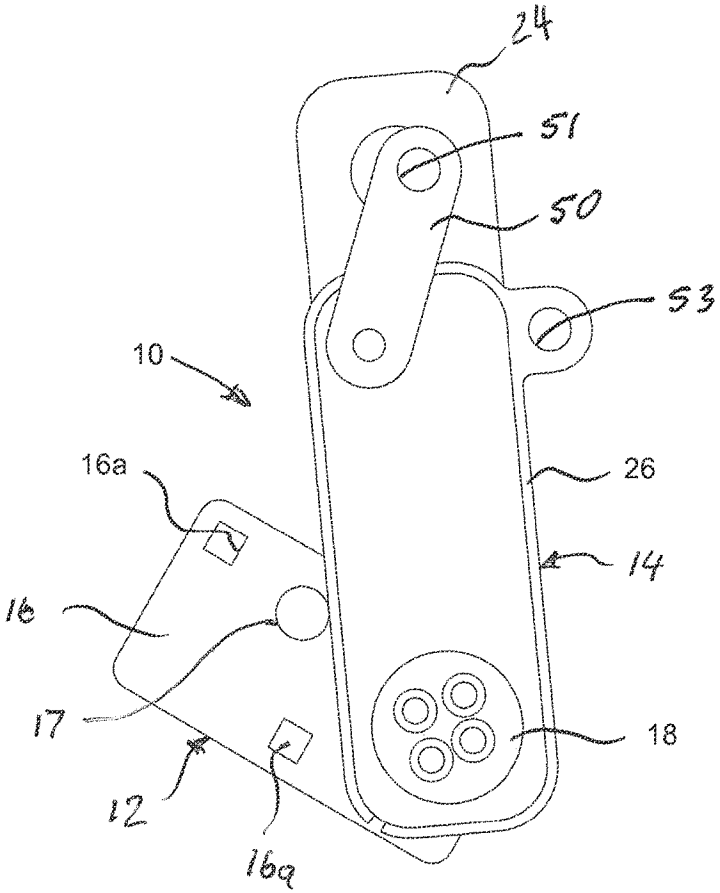
FIG. 15 is a side view of the locking device according to the exemplary embodiment of the present invention in the closed position without the padlock and with the manual release lever in the override position.
Figure 20:
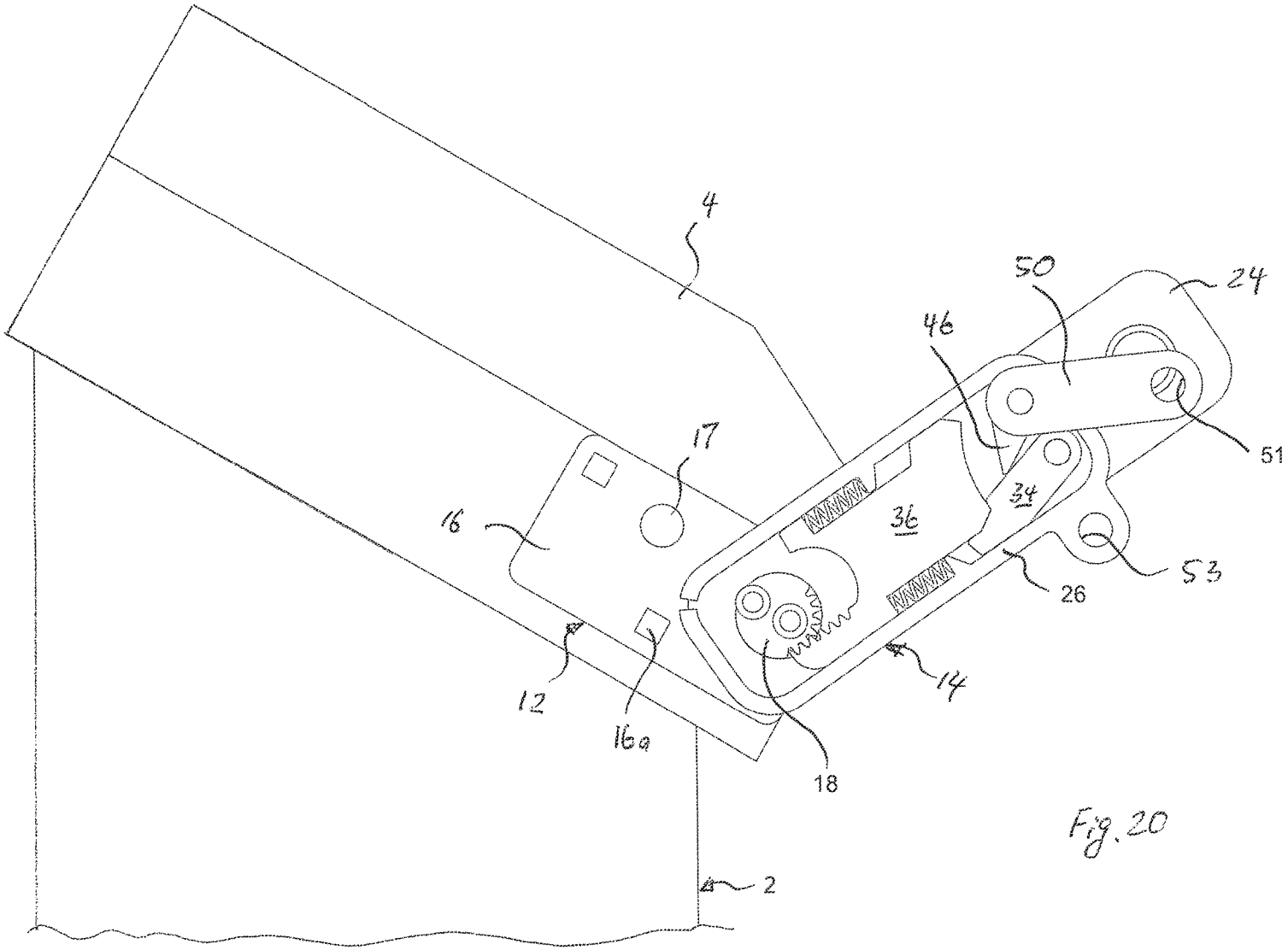
FIG. 20 is a side view of the waste container in the upright position with closed lid and the locking device according to the exemplary embodiment of the present invention in the open position without the padlock and with the manual release lever in the override position, showing the locking mechanism in the release position, without the cover plate and the outer plate.

In order to bypass the locking mechanism 32, the padlock 52 is unlocked and removed from the lock casing 28 to unlock the manual release lever 50 from the lock casing 28, then the manual release lever 50 is rotated counterclockwise to a position shown in FIGS. 13-15. Subsequently, the locking bar 6 is rotated clockwise to a position shown in FIGS. 16-19. In this position, the locking bar 6 is horizontally spaced away from the hinged lid 4 of the waste container 2 so as to allow the opening of the hinged lid 4 of the waste container 2, as illustrated in FIGS. 20 and 21. In other words, the locking device 10 allows bypassing the gravity operated locking mechanism 32 by rotating the manual release lever 50 by an authorized person.

Figure 5B:
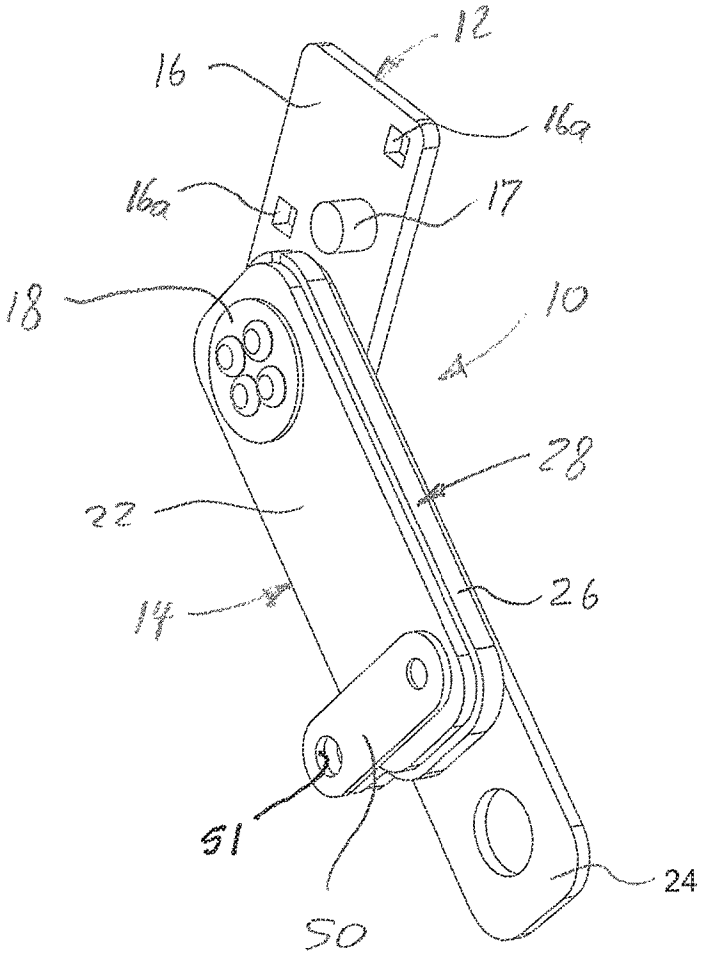
FIG. 5B is perspective views of the locking device according to the exemplary embodiment of the present invention, shown in the open position without the padlock.
Figure 6:
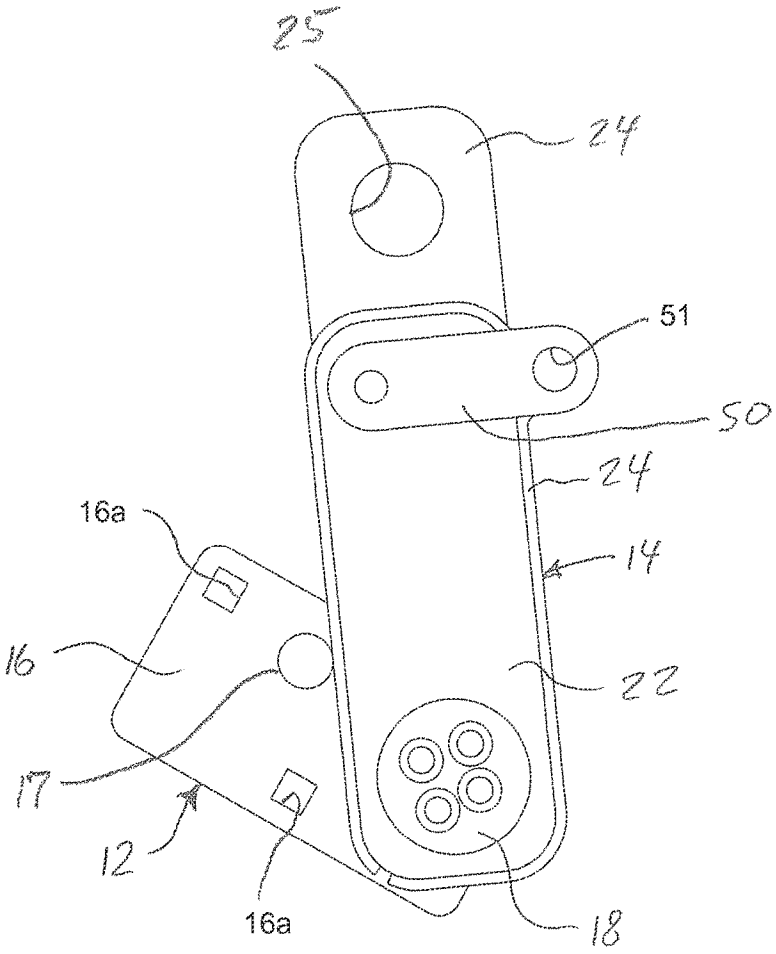
FIG. 6 is a side view of the locking device according to the exemplary embodiment of the present invention in the closed position.

In operation, when it is desirable to empty the refuse, the waste container 2 is grabbed by a lifting mechanism of a waste collection truck (not shown), and is moved from the upright storage position to the tilted or dumping position. Initially, the locking member 34 of the gravity operated locking mechanism 32 is in the first blocking position (as shown in FIG. 10). Accordingly, the pivoting unit 14 is not allowed to pivot to its open position. However, when the waste container 2 is substantially tipped forward or tilted a predetermined angle, about 45°, the locking member 34 pivots by gravity from the blocking position (shown in FIG. 10) to the release position (shown in FIG. 13) so that the distal end of the locking member 34 slides along the arcuate surface 44 of the sliding member 36. In this position the locking member 34 no longer obstructs the linear displacement of the sliding member 36 relative the pinion member 18. Subsequently, the pivoting unit 14 is allowed to pivot (by gravity of the pivoting unit 14, the pivoting arm 8 and the locking bar 6) to its open position, as shown in FIG. 5B. Consequently, the pivoting unit 14 and the locking bar 6 rotate by gravity from the closed position to the open position thereof (shown in FIG. 4). As the pivoting unit 14 rotates relative to the pivot axis X (or the pinion member 18), the sliding member 36, which drivingly engages the pinion member 18, is linearly displaced in the direction away from the pinion member 18 and toward the locking member 34, because, due to the relative rotation of the sliding member 36 relative to the pinion member 18, the gear teeth 42 of the rack portion 40 of the sliding member 36, which are engaged with the gear teeth 20 of the pinion member 18, move the sliding member 36 linearly relative to the pinion member 18.

Sequentially, the lid 4 of the waste container 2 swings open by gravity permitting the content of the waste container 2 to be emptied (as best shown in FIG. 4).

Moreover, the arcuate stop surface 43 of the locking member 34 (best shown in FIGS. 7 and 8) configured to engage the arcuate surface 44 of the sliding member 36 (best shown in FIGS. 7, 9 and 10) when the locking member 34 is in the blocking position and the sliding member 36 is linearly displaced in the direction toward the pinion member 18, thus restraining clockwise rotation of the pivoting unit 14 and the locking bar 6 about the pivot axis X.

Furthermore, when the locking member 34 is in the release position thereof and the pivoting unit 14 rotates to the open position thereof, the sliding member 36 is linearly displaced in the direction away from the pinion member 18 and toward the locking member 34 until the arcuate surface 44 of the sliding member 36 engages a stop notch 45 formed on the locking member 34 (as best shown in FIGS. 8 and 12) for limiting linear displaced of the sliding member 36 in the direction away from the pinion member 18.

It will be appreciated that the gravity operated locking mechanism 32 operates automatically and independently of locking condition of the manual release lever 50. In other words, when the waste container 2 is tilted, the locking mechanism 32 is open whether the manual release lever 50 is locked with the padlock 52 or not. As the waste container 2 is returned to its initial upright storage position, the lid 4 closes by gravity, then the pivoting unit 14 and the locking bar 6 move by gravity to the closed position, and the locking member 34 is returned to the blocking position.

Figure 16:
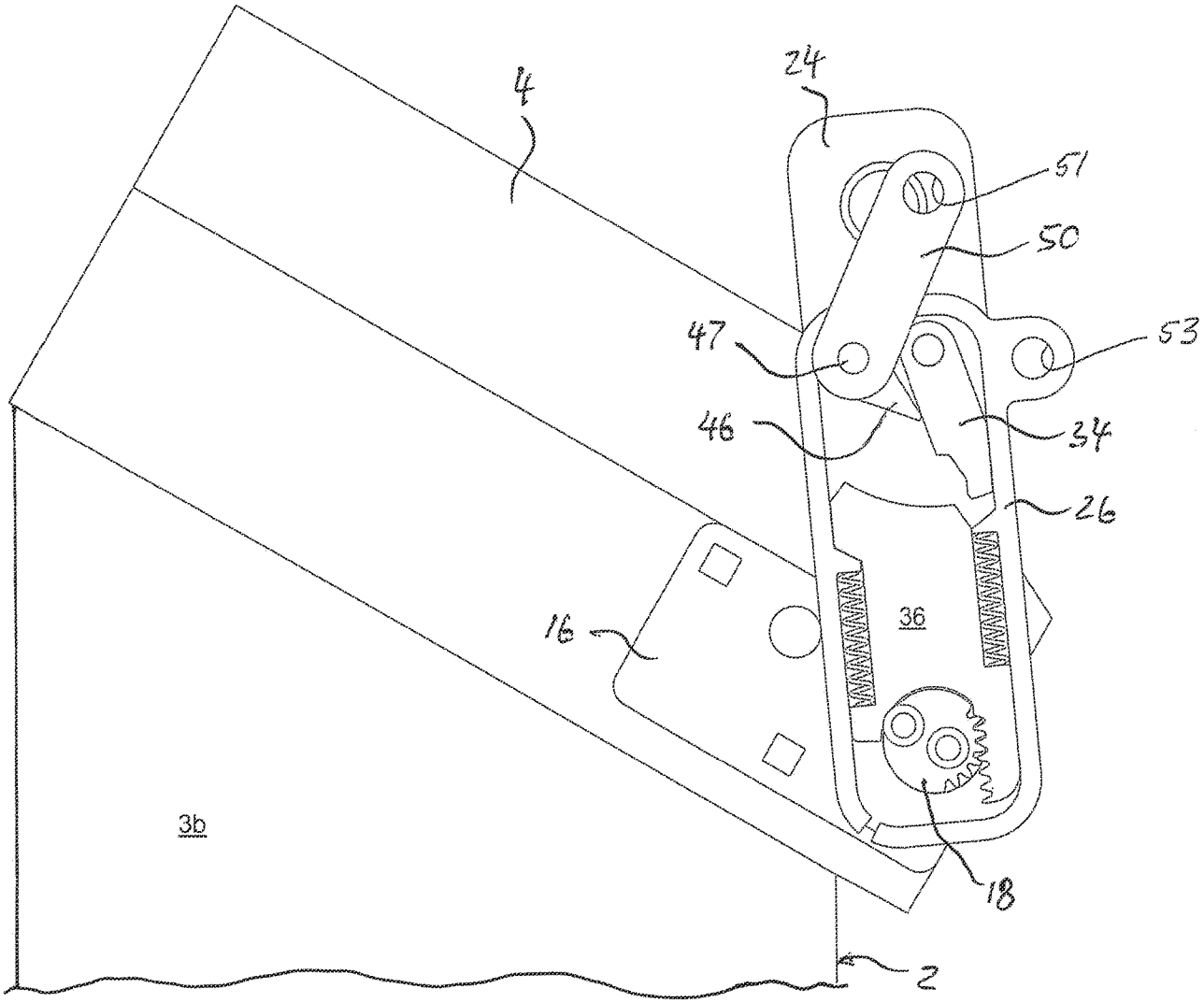
FIG. 16 is a side view of the waste container in the upright position with closed lid and the locking device according to the exemplary embodiment of the present invention in the closed position without the padlock and with the manual release lever in the override position, showing the locking mechanism in the release position, without the cover plate and the outer plate.
Figure 17:
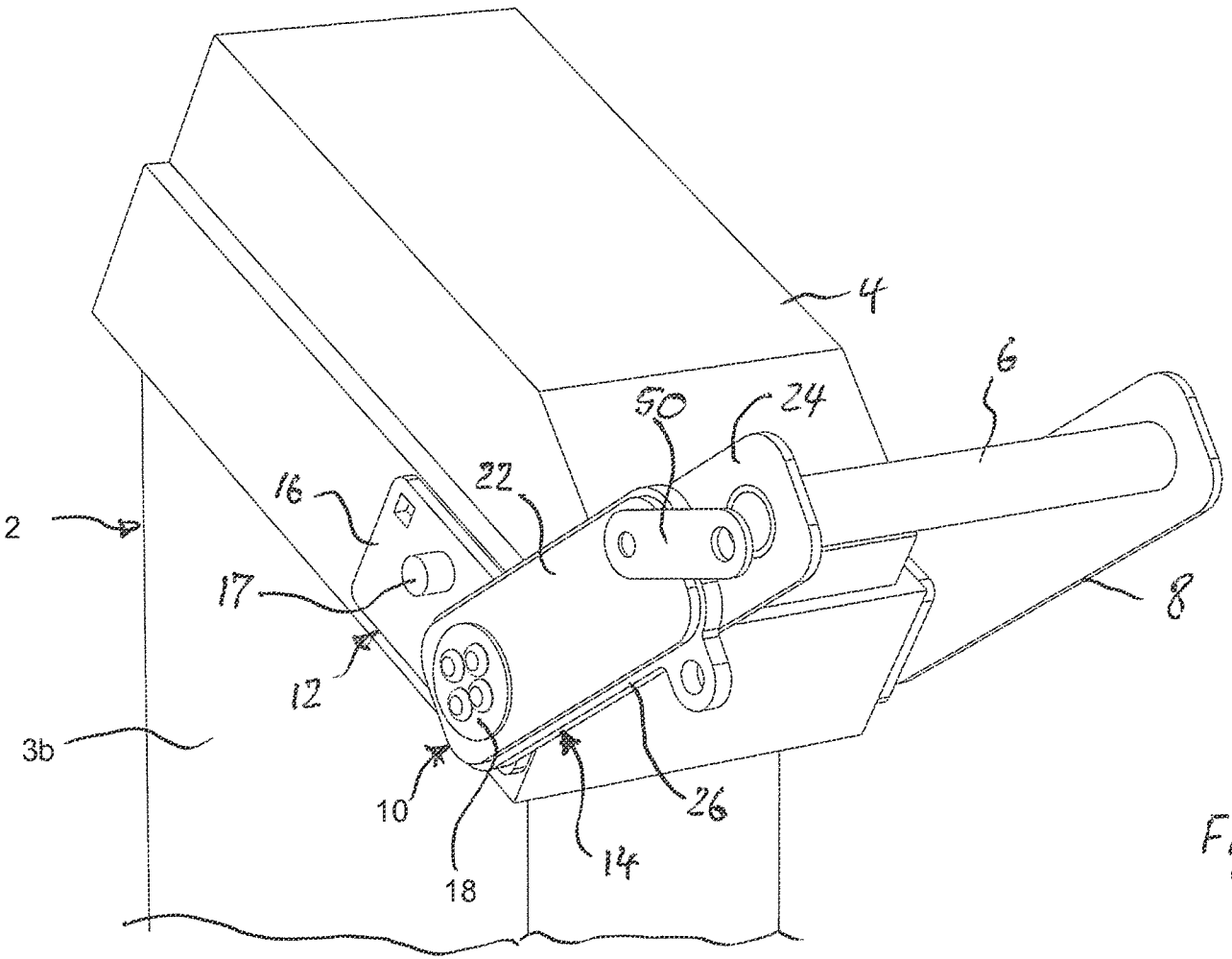
FIG. 17 is a perspective view of the waste container in the upright position with closed lid and the locking device according to the exemplary embodiment of the present invention shown in the open position without the padlock and with the manual release lever in the override position.

Manual release of the locking member 34 by an authorized person can be achieved the pivot lever 46. When the padlock 52 is in place (i.e. the pivot lever 46 is in the locked position), the movement of the manual release lever 50 (thus the pivot lever 46) is restricted. When the padlock 52 is removed by an authorized person using a designated key, the manual release lever 50 is allowed to pivot counterclockwise (as best shown in FIGS. 14-22) at which time the distal end of the pivot lever 46 moves the locking member 34 to its release position (as best shown in FIG. 16) which then allows the pivoting unit 14 with the locking bar 6 to pivot to its open position as shown in FIGS. 17-22.

The foregoing description of the exemplary embodiment(s) of the present invention has been presented for the purpose of illustration in accordance with the provisions of the Patent Statutes. It is not intended to be exhaustive or to limit the invention to the precise forms disclosed. The embodiments disclosed hereinabove were chosen in order to best illustrate the principles of the present invention and its practical application to thereby enable those of ordinary skill in the art to best utilize the invention in various embodiments and with various modifications as suited to the particular use contemplated, as long as the principles described herein are followed. This application is therefore intended to cover any variations, uses, or adaptations of the invention using its general principles. Further, this application is intended to cover such departures from the present disclosure as come within known or customary practice in the art to which this invention pertains. Thus, changes can be made in the above-described invention without departing from the intent and scope thereof. It is also intended that the scope of the present invention be defined by the claims appended thereto.

What is claimed is:

1. A locking device for locking a locking bar of a container having a hinged lid, said locking device comprising:

a base unit including base member adapted to be fixed to the container and a pinion member attached to said base member; and a pivoting unit pivotally mounted to said base unit;

said pivoting unit including a lock casing defining a cavity housing a locking mechanism for rotation about said base unit and said pinion member, said locking mechanism comprising locking member pivotally mounted to said lock casing, a sliding member reciprocatingly and slidingly movable between said locking member and said pinion member within said cavity in said lock casing;

said sliding member drivingly and positively engaging said pinion member so that the rotational movement of said sliding member relative to said pinion member causes the linear displacement of said sliding member relative to said pinion member;

said locking member pivotally movable between a blocking position preventing the movement of said sliding member relative said pinion member so as to prevent relative movement between said pivoting unit and said base unit, and a release position permitting the movement of said sliding member relative said pinion member so as to permit relative movement between said pivoting unit and said base unit.

2. The locking device according to claim 1, wherein said pinion member has at least one gear tooth; and wherein said sliding member having a rack portion with at least one gear tooth in mesh with said at least one gear tooth of said pinion member.

3. The locking device according to claim 2, wherein said at least one gear tooth of said pinion member includes gear teeth along at least a portion of a perimeter thereof; and wherein said at least one gear tooth of said rack portion of said sliding member includes gear teeth in mesh with said gear teeth of said pinion member.

4. The locking device according to claim 1, wherein said locking mechanism further comprises biasing spring disposed in said cavity between said lock casing and said sliding member so as to bias said sliding member in the direction toward said pinion member.

5. The locking device according to claim 1, wherein said pivoting unit comprises a series of plate-shaped members fixed together so as to form said lock casing; said locking mechanism is disposed within said lock casing.

6. The locking device according to claim 5, wherein said series of plate-shaped members includes an inner plate pivotally mounted to said base member, an outer plate non-movably attached to said inner plate, and a hollow plate-shaped intermediate member sandwiched between said inner plate and said outer plate so as to define said lock casing defining said cavity therein.

7. The locking device according to claim 6, wherein said locking member and said sliding member have a thickness substantially equal to or less than a thickness of said intermediate member.

8. The locking device according to claim 6, further comprising a locking bar fixed to said pivoting unit so as to extend substantially across the length of said container, said locking bar being movable between a closed position wherein said locking bar extends over said hinged lid of said container so as to prevent opening of said container, and an open position wherein said locking bar is spaced away from said hinged lid of said container so as to allow the opening of said container.

9. The locking device according to claim 8, wherein said locking bar is mounted to said inner plate.

10. The locking device according to claim 1, further comprising a pivot lever provided to engage said locking member in said blocking position to push said locking member out of said blocking position toward said release position.

11. The locking device according to claim 10, further comprising a manual release lever non-rotatably connected to said pivot lever for manually moving said pivot lever against said locking member to move said locking member from said blocking position to said release position regardless of a tilt angle of said locking mechanism.

12. The locking device according to claim 1, further comprising a manual release lever rotatably mounted to said pivoting unit for manually moving said locking member from said blocking position to said release position regardless of a tilt angle of said locking mechanism and a locking apparatus provided for locking said manual release lever to said pivoting unit so as to prevent rotational movement of said manual release lever relative to said pivoting unit.

13. The locking device according to claim 1, wherein said base unit 1 further includes a stop member non-moveably secured to said base member and axially extending therefrom for limiting rotation of said pivoting unit in one direction.

14. A locking device for a container having a hinged lid and a locking bar, said locking device comprising:

a pinion member being adapted to be fixed to the container, said pinion member including gear teeth along at least a portion of a perimeter thereof;

a pivoting unit pivotable around the pinion member, said locking bar secured to the pivoting unit and is movable between a closed position wherein said locking bar extends over said hinged lid of said container so as to prevent opening of said container, and an open position wherein said locking bar is spaced away from said hinged lid of said container so as to allow the opening of said container; and a locking mechanism disposed within a cavity of the pivoting unit, said locking mechanism comprising a locking member pivotally mounted to the pivoting unit, a sliding member reciprocatingly and slidingly movable between said locking member and said pinion member within said cavity;

said sliding member having a rack portion with gear teeth in mesh with said gear teeth of said pinion member so that the rotational movement of said sliding member relative to said pinion member causes the linear displacement of said sliding member relative to said pinion member;

said locking member having an arcuate stop surface of a distal end of the locking member provided to engage and disengage an arcuate surface of said sliding member relative said pinion member;

said locking member pivotally movable relative to said sliding member between a blocking position in which said arcuate stop surface of said locking member engages said arcuate surface of said sliding member thereby preventing relative movement between said pivoting unit and said sliding member, thereby maintaining the locking bar in a closed position, and a release position when said container, and thus said locking member, is tilted, permitting relative movement between said pivoting unit and said sliding member as said arcuate stop surface of said locking member moves away from said arcuate surface of said sliding member, thereby allowing the locking bar to move to an opened position.

15. The locking device according to claim 14, wherein when said locking bar is in the closed position, said locking bar extends over said hinged lid of said container so as to prevent opening of said container, and when said locking bar is in the open position, said locking bar is spaced away from said hinged lid of said container so as to allow the opening of said container.

16. The locking device according to claim 14, wherein said locking mechanism further comprises biasing spring disposed in said cavity between said pivoting unit and said sliding member so as to bias said sliding member in the direction toward said pinion member.

17. The locking device according to claim 14, wherein said pivoting unit includes an inner plate configured to be pivotally mounted to the container, an outer plate non-movably attached to said inner plate, and a hollow plate-shaped intermediate member sandwiched between said inner plate and said outer plate so as to define said cavity therein.

18. The locking device according to claim 17, wherein the locking bar is mounted to said inner plate.

19. The locking device according to claim 14, further comprising a manual release lever for manually moving said locking member from said blocking position to said release position regardless of a tilt angle of said locking mechanism.

20. The locking device according to claim 19, further comprising a pivot lever provided to engage said locking member in said blocking position to push said locking member out of said blocking position toward said release position; wherein said manual release lever is connected to said pivot lever for manually moving said pivot lever from said blocking position to said release position regardless of a tilt angle of said locking mechanism.

* * * * *